US008539887B2

(12) United States Patent
Pazhoor

(10) Patent No.: US 8,539,887 B2
(45) Date of Patent: Sep. 24, 2013

(54) MULTI-PURPOSE, ADJUSTABLE AND NESTABLE VOTING BOOTH

(75) Inventor: Mohamed Pazhoor, West Palm Beach, FL (US)

(73) Assignee: Naztec International Group, LLC, West Palm Beach, FL (US)

( * ) Notice: Subject to any disclaimer, the term of this patent is extended or adjusted under 35 U.S.C. 154(b) by 0 days.

(21) Appl. No.: 13/227,912

(22) Filed: Sep. 8, 2011

(65) Prior Publication Data

US 2013/0063007 A1 Mar. 14, 2013

(51) Int. Cl.
*A47B 57/00* (2006.01)

(52) U.S. Cl.
USPC ..... 108/60; 108/6

(58) Field of Classification Search
USPC ..... 108/91, 92, 115, 1, 4, 6, 8, 9, 10, 108/23, 44; 312/140.2, 258, 223, 259, 244, 312/239, 257 R, 257 A, 231, 233, 195, 223.5, 312/223.3, 223.2, 223.1, 257.1
See application file for complete search history.

(56) References Cited

U.S. PATENT DOCUMENTS

| | | | | | |
|---|---|---|---|---|---|
| 2,449,492 | A * | 9/1948 | Long | 248/454 |
| 3,550,540 | A * | 12/1970 | Harris et al. | 108/23 |
| 4,231,297 | A * | 11/1980 | Holbek | 108/10 |
| 4,248,161 | A * | 2/1981 | Adair et al. | 108/6 |
| 4,726,556 | A * | 2/1988 | Weir | 248/454 |
| 4,938,153 | A * | 7/1990 | Maes | 108/6 |
| 5,878,672 | A * | 3/1999 | Ostermann et al. | 108/44 |
| 6,810,820 | B1 * | 11/2004 | Okerlund et al. | 108/50.01 |
| 7,258,321 | B1 * | 8/2007 | Storrs | 248/251 |
| D596,187 | S * | 7/2009 | Martell | D14/447 |
| D616,667 | S * | 6/2010 | Pazhoor | D6/421 |
| 2010/0031855 | A1 * | 2/2010 | Zhu | 108/4 |

* cited by examiner

*Primary Examiner* — Jose V Chen
(74) *Attorney, Agent, or Firm* — McHale & Slavin, P.A.

(57) ABSTRACT

A multi-purpose, adjustable voting booth adapted to provide a single structure which can be used as a standard sized voting booth as well as a voting booth that is usable by wheel chair bound individuals is provided. The voting booth includes a privacy booth support structure rotatably attached to a main body support structure and a privacy booth. The main body support structure comprises a pair of vertically extending frames, each attaching to the privacy booth support structure along a first end and rotatably attaching to a lower base frame assembly along a second end for providing vertical height adjustment. The voting booth is also adapted to be nestable with like shaped voting booths therefore eliminating the need for excessive storage.

18 Claims, 32 Drawing Sheets

MULTI-PURPOSE, ADJUSTABLE AND NESTABLE VOTING BOOTH

CROSS REFERENCE TO RELATED APPLICATIONS

This application is related to U.S. Design application 29/355,765 filed on Feb. 12, 2010, entitled "HANDICAPPED ACCESSIBLE PORTABLE VOTING BOOTH" the entirety of which is incorporated herein by reference.

FIELD OF THE INVENTION

This invention relates to voting booths; and in particular to a multi-purpose voting booth that is easily and quickly adjustable between standard sized voting booths and voting booths which are Americans with Disability Act compliant and which are nestable for efficient storage capability.

BACKGROUND OF THE INVENTION

Voting booths provide an area of privacy for those exercising the right to vote. Whether the vote is for electing an individual to a position of leadership, or deciding whether to tax cigarettes, the right to vote is a most private matter. For this reason, voting booths of most every configuration can be found; all with a purpose of providing an area of privacy for the individual exercising their freedom to vote. For instance, stand alone units are well known wherein curtains are hung around the individual for privacy. More elaborate booths might have computer terminals built into the stands.

Most every voting booth is portable as they are used only temporarily. The voting process is performed on a predefined date, and depending on the type of election, might require assembly once, twice or multiple times per year. Due to the amount of people that are involved in voting, a school or church having a large area is typically employed. For instance, a school cafeteria may be employed wherein portable stands are assembled and made available for the voting public. Without such devices, the election process would fail to render the actual beliefs of the voters.

There are numerous types of voting booths, each having a configuration that permits various degrees of privacy. For example, U.S. Pat. No. 4,445,731 describes a portable voting booth. U.S. Pat. No. 4,854,652 describes a dual voting both comprising members that fit together to form a compact carrying case for other components. U.S. Pat. No. 6,827,262 describes another type of portable voting booth. U.S. Pat. No. 7,895,954 describes a nestable voting booth. One shortcoming associated with current systems relates to the need for municipalities to provide voting booths that are standard in size, as well as voting booths that are compliant with federal laws, such as the Americans with Disabilities Act (ADA). Voting booths sized to accommodate individuals using a wheel chair have been designed as independent voting booths which differ from standard booths. Such arrangement results in increased costs as municipalities are forced to buy not only standard sized voting booths, but also independent voting booths which accommodate wheel chair bound voters. In addition to the increased costs of having to buy and maintain a larger pool of voting booths, having two different types of voting booths makes it harder for municipalities to store such large number of booths. Moreover, having to distribute and set up a large amount of voting booths increases the time and number of city employees and/or volunteers required to set up in the voting places on election days, thereby increasing costs.

Therefore, what is needed in the art is an easily storable, nestable, single voting booth that is adjustable to various heights, including heights that allow wheelchair bound individuals to easily use such booths.

SUMMARY OF THE INVENTION

The instant invention is a multi-purpose, adjustable voting booth which is a stand alone structure designed to provide easy storage. The stand-alone structure in accordance with the instant invention is designed to provide variable adjustments in height to allow for standard usage, ADA compliant usage, and usage in between. The structure is also designed to be multi-functional. While it will be described as providing a movable structure useful for providing an area for voting, because of its portability and ability to create a semi-private space, the structure can also be useful in other applications. For example, such structure can be used in libraries to create additional viewing/reading areas, allowing the library staff to adjust to times of high/low patron use. Creating additional "desks" for students provide schools an opportunity to easily and quickly respond to changes in enrollment. These structures may also find particular use for governmental agencies which, for example, during times of natural disasters may need to set up temporary processing areas.

At least one embodiment includes a privacy booth support structure for supporting a privacy booth and providing the privacy booth rotatable movement. The privacy booth support structure is rotatably attached to a main body support structure for providing angular adjustment to the privacy booth support structure. The main body support structure has a pair of vertically extending frames. Each of the vertical frames attach to the privacy booth support structure along a first end and rotatably attach to a lower base frame assembly along a second end for providing vertical height adjustment. Movement of the vertical frames change the distance between the privacy booth structure and the surface which the voting booth is resting upon. Movement of the privacy booth support structure changes the angular position of the privacy booth structure. The voting booth is also adapted to nest with a like-structured voting booth wherein the voting booth is slidably receivable underneath a like structured voting booth.

Accordingly, it is an objective of the instant invention to provide a single voting booth that can be used by a plurality of differently sized individuals.

It is a further objective of the instant invention to provide a single voting booth that is adjustable.

It is yet another objective of the instant invention to provide a single voting booth that is adjustable between standard usage and ADA compliant usage.

It is a still further objective of the instant invention to provide a single voting booth that quickly and easily adjusts from being usable by individuals who are bound by wheel chairs to being usable by individuals who do not use wheel chairs.

It is a further objective of the instant invention to provide a single voting booth in which the angular positioning of the privacy booth can be changed.

It is yet another objective of the instant invention to provide a single voting booth in which the distance between the privacy booth and the surface which the voting booth is placed upon can be changed.

It is a still further objective of the invention to provide a single voting booth in which the angular positioning of the privacy booth and the distance between the voting booth and the surface which the voting device is placed upon can be manipulated.

It is a further objective of the instant invention to provide a single voting booth which is adjustable and nestable.

It is yet another objective of the instant invention to provide an adjustable voting booth that includes a privacy booth that is slidably attached to support assemblies.

It is a still further objective of the instant invention to provide an adjustable voting booth that includes a motion sensor light.

It is yet another objective of the instant invention to provide an adjustable voting booth having features which enhance the user's interaction with the voting booth.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
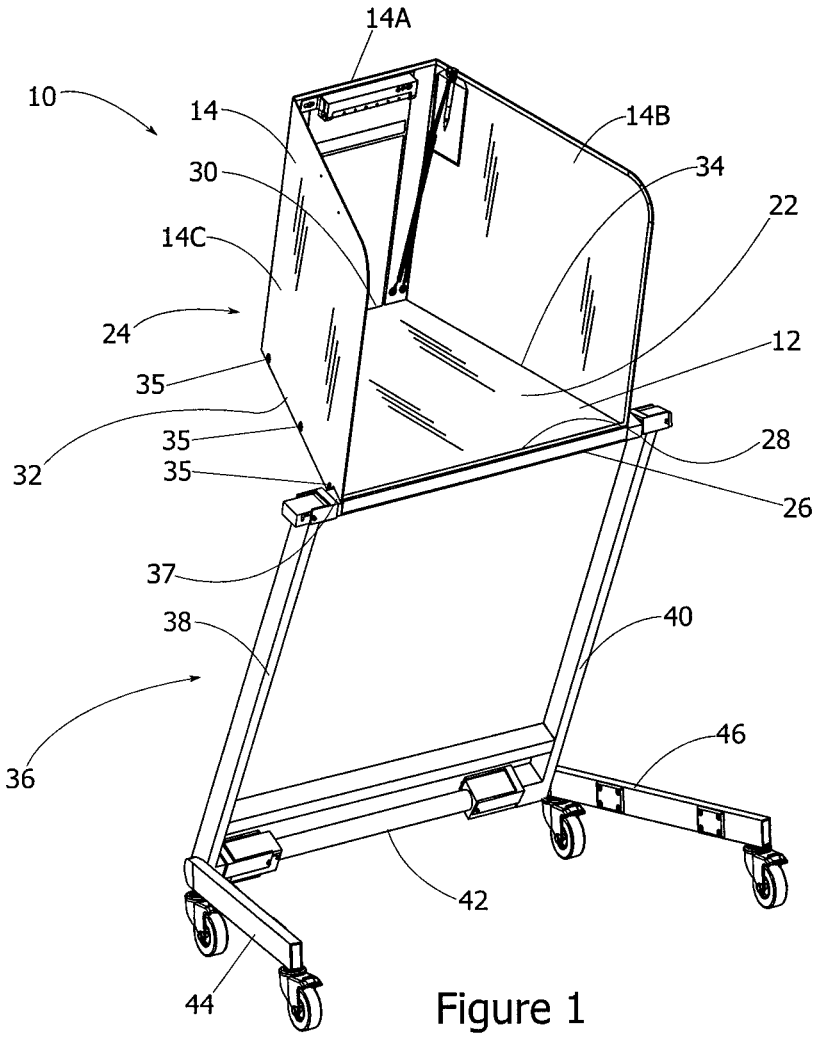
FIG. 1 is a perspective view of the multi-purpose, adjustable voting booth of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
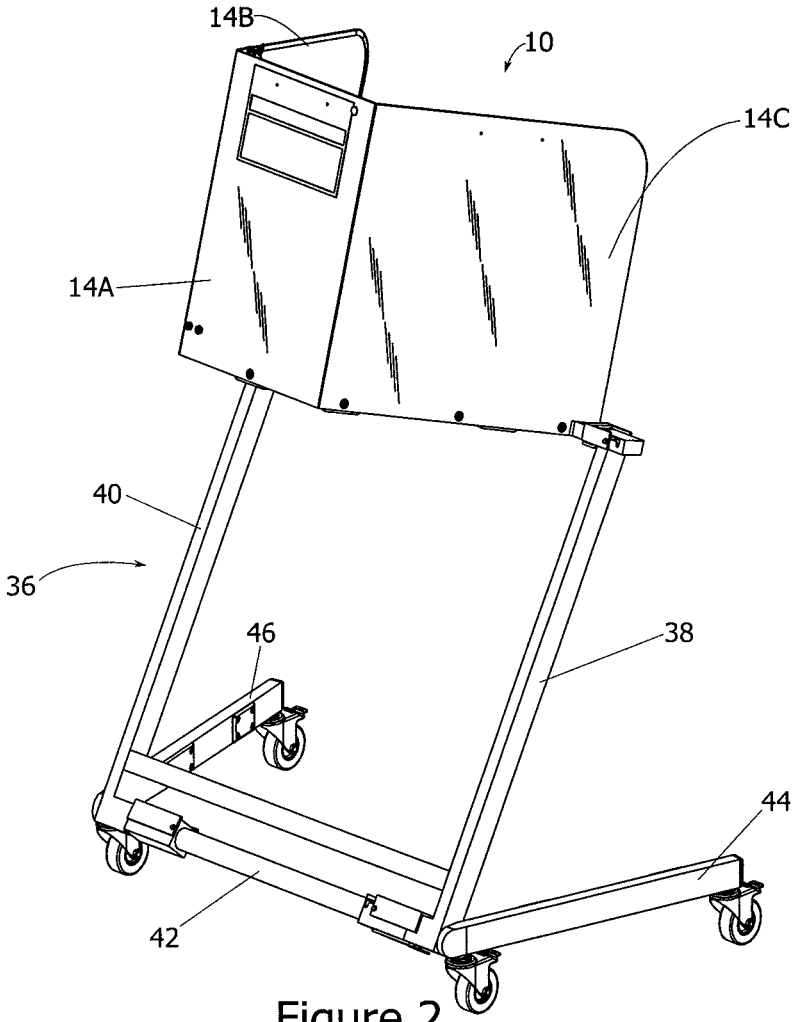
FIG. 2 is a rear perspective view thereof.
Figure 16A:
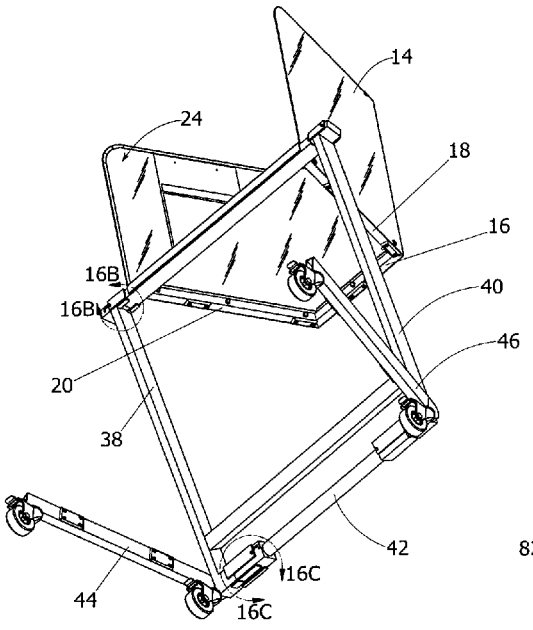
FIG. 16A is a bottom perspective view of the multi-purpose adjustable voting booth of the present invention shown in the standard configuration.
Figure 16B:
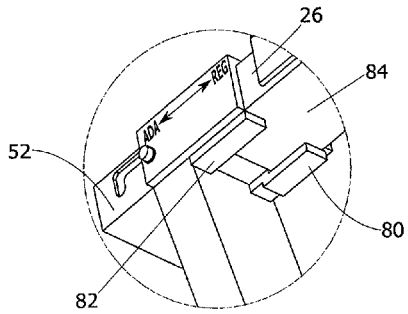
FIG. 16B is an enlarged section of 16B illustrated in FIG. 16A, showing additional swivel angle limiting devices in accordance with the instant invention.
Figure 16C:
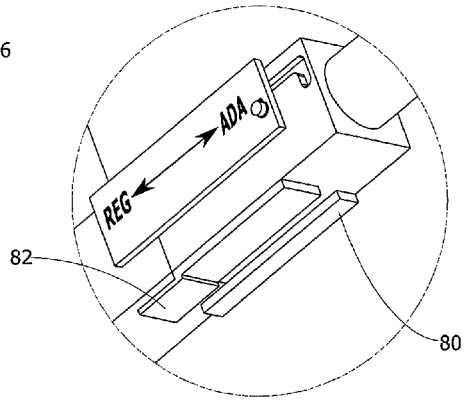
FIG. 16C is an enlarged section of 16C illustrated in FIG. 16A, showing additional swivel angle limiting devices in accordance with the instant invention.
Figure 17A:
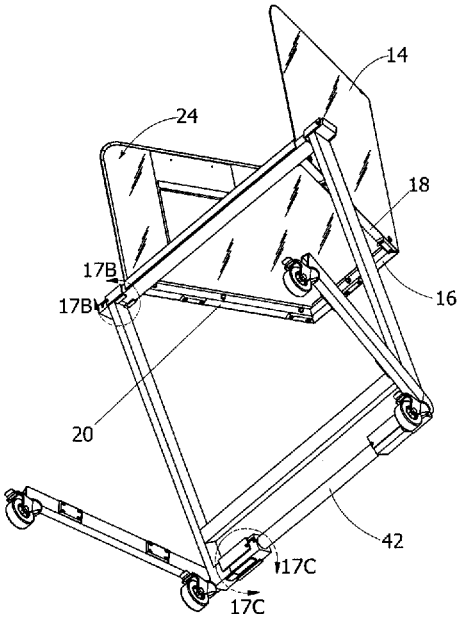
FIG. 17A is a bottom perspective view of the multi-purpose adjustable voting booth of the present invention shown in the ADA compliant configuration.

Referring to FIGS. 1 and 2, front and rear perspective views of the multi-purpose, adjustable voting booth 10 are illustrated. The voting booth 10 includes a usable panel 12 surround by an up-facing privacy shield 14. The privacy shield 14 is constructed as a single unit having three sides, a rear side 14A, and two opposing sides 14B, and 14C. The usable panel 12 may be made of any material which provides a user the ability to set materials upon the surface as well as write on materials resting there upon. The material is preferably made of a metal, but can be made of plastic, wood, or other materials. While the usable panel 12 is shown having a generally trapezoidal shape, other shapes may be utilized, which may require additional or less number of sides. Preferably, the usable panel 12 is inclined, but need not be arranged in this manner. The usable panel 12 is preferably secured to a separate base frame assembly constructed of generally rectangular tubular structures 16, 18 and 20, see FIG. 16A or 17A, which are welded together. Each of the sides 14A, 14B, and 14C extend upwardly from the top surface 22 of the usable panel 12 to provide a private area where viewing what the user is doing within the partially enclosed area formed by the privacy shield 14, or what is placed on the usable panel 12, is limited or prevented. The usable panel 12 is preferably welded (both inside and outside) on top of the upper base frame assembly so that the usable panel 12 extends to the outer edge of each of the generally rectangular tubular structures 16, 18 and 20. While not illustrated, the privacy shield 14 may contain a fourth side which is arranged parallel to and positioned opposite the usable surface 12. Such side, if used, would form a top panel to prevent a third party from viewing down upon the usable panel 12. The upper base frame assembly, the privacy shield, along with the usable panel 12 forms a privacy booth 24 allowing the user to write, read, or cast a vote with relative privacy.

The privacy booth 24 is secured to a support structure through a rotatable privacy booth support frame 26. The booth support frame 26 is preferably secured to the privacy booth 24 through the generally rectangular tubular structures 18 and 20 (see for example FIG. 17A), such as through welding, so that the booth support frame 26 provides additional support for the privacy booth 24. Additionally, as the booth support frame 26 rotates, the privacy booth 24 rotates accordingly. As illustrated in FIG. 1, the front edge 28 of the usable surface 12 is secured to the top surface or face of the booth support frame 26 and extends to at or near the outer edge. The opposing rear edge 30 of the usable surface 12 is not in a direct securable arrangement with the booth support frame 26. Opposing side edges 32 and 34 of the usable surface 12, which extend outwardly away from the booth support frame 26, may have minimal securable engagement with the booth support frame 26. Such minimal contact may include an area at or near where the front edge 28 of the usable panel 12 and the opposing side edges 32 and 34 meet. The privacy panel 14 is secured to the base frame assembly generally rectangular tubular structures 16, 18 and 20 through securing devices, such as but not limited to, bolts 35 and nuts (not shown). The privacy panel 14 is preferably arranged so that it does not secure to the top surfaces of the base frame assembly generally rectangular tubular structures 16, 18 and 20. The privacy panel 14 is preferably secured to the side or side surfaces of each of the base frame assembly generally rectangular tubular structures 16, 18 and 20. Each of the sides 14B and 14C preferably contain a cut-out portion 37 which allows the privacy shield 14 to rest on the top surface of the booth support frame 26, extending to its outer edge. Accordingly, the privacy shield 14 fully surrounds the peripheral rear edge and the side edges of the usable surface 12.

Figure 19:
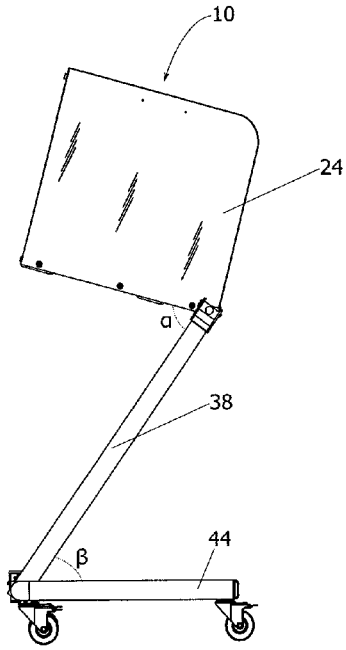
FIG. 19 is a side view of the multi-purpose adjustable voting booth of the present invention shown in the ADA compliant configuration.
Figure 41:
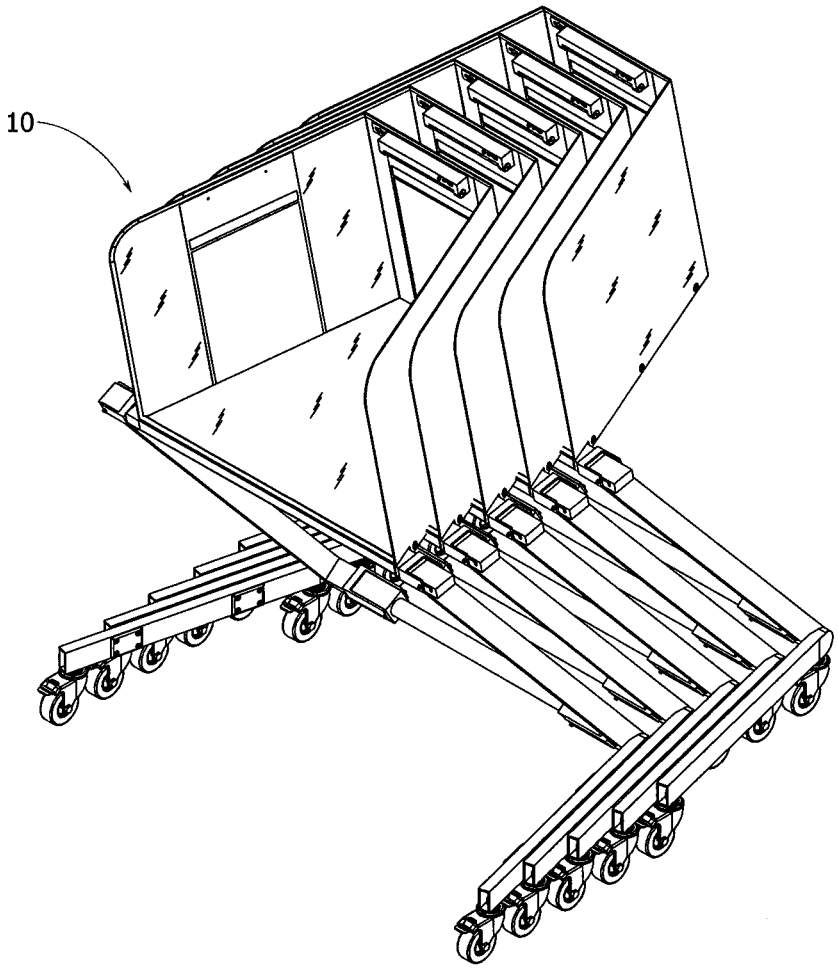
FIG. 41 is a perspective view of a plurality of the multi-purpose adjustable voting booths of the present invention shown in nesting arrangement.
Figure 42:
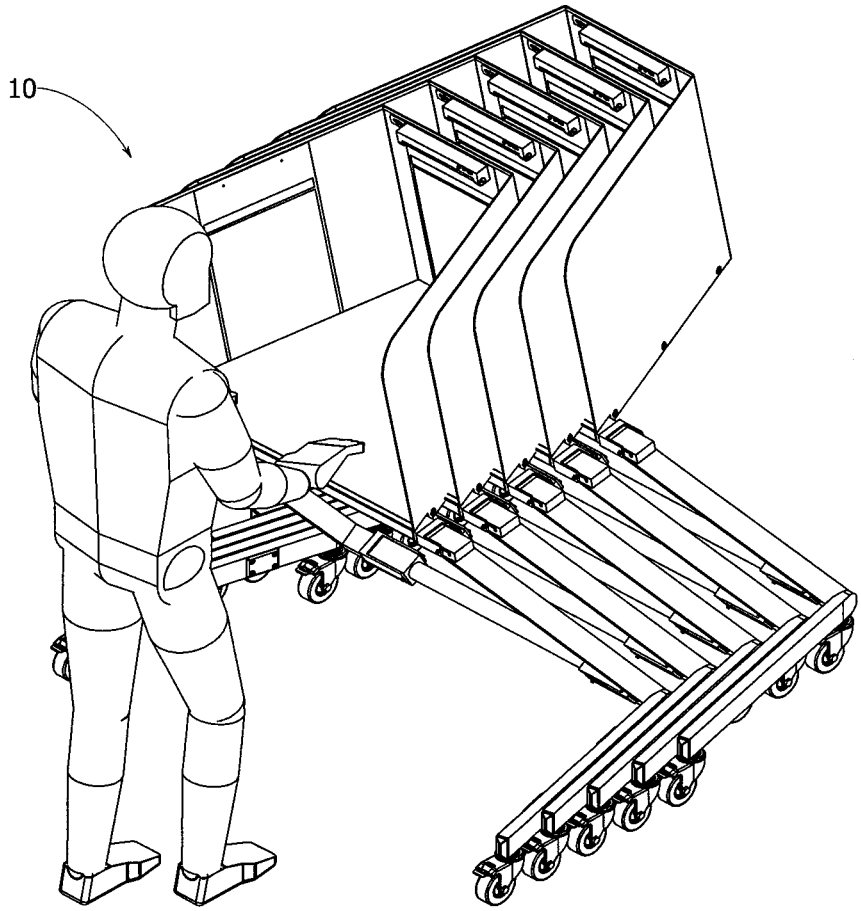
FIG. 42 is a perspective view of a plurality of the multi-purpose adjustable voting booths of the present invention shown in nesting arrangement being moved by an individual.

The booth support frame 26 provides engagement of the privacy booth 24 with a main body support structure 36 having a mid-frame assembly (generally structures 38 and 40) and a lower base frame assembly (generally structures 42, 44, and 46). The support structure 36 comprises two opposing frames, a left vertical frame 38 and a right vertical frame 40, each being securable to the booth support frame 26. A support structure horizontal frame 42, which is arranged in a generally parallel manner to booth support frame 26 is secured to the left vertical frame 38 and the right vertical frame 40, as well as to two base frame support structure frames, left bottom base support frame 44 and right bottom base support frame 46. The left vertical frame 38 and the right vertical frame 40 may be secured to the booth support frame 26 and the two base frame support structure 44, 46 frames in a perpendicular manner. However, it is preferable that the vertical frames are inclined, so that the angle formed by engagement of the vertical frames and base support frames form acute angles. Securing of the booth support frame 26 with the privacy booth 24 to the support structure 36 provides the voting booth 10 with a Z-shaped configuration, see for example FIG. 2, 19, or 20. The positioning or placement of each of the parts of the voting booth 10 is designed to allow like-shaped voting booths 10 to fit within, or nest with other like-shaped voting booths, see FIGS. 41 and 42, to minimize the amount of space needed to store such structures.

The voting booth 10 is structured to allow pivotable rotation of the booth support frame 26, thereby providing the privacy booth 24 with adjustable positioning or alignment. In addition, the voting booth 10 is constructed to allow the left vertical frame 38 and the right vertical frame 40 pivotable rotation, thereby providing adjustable vertical positioning of the privacy booth 24. Moving the left vertical frame 38 and/or the right vertical frame 40 in a forward or backwards direction changes the distance between the privacy booth 24 and the surface in which the voting booth 10 rests upon. By providing adjustable positioning of the privacy booth 24 and the vertical frames 38/40, the voting booth 10 has the capability of quickly, easily and safely adjusting to users of different heights as well as wheelchair bound users which require voting booths that rest closer to the ground. Such functionality provides ADA compliant voting booths.

Figure 3:
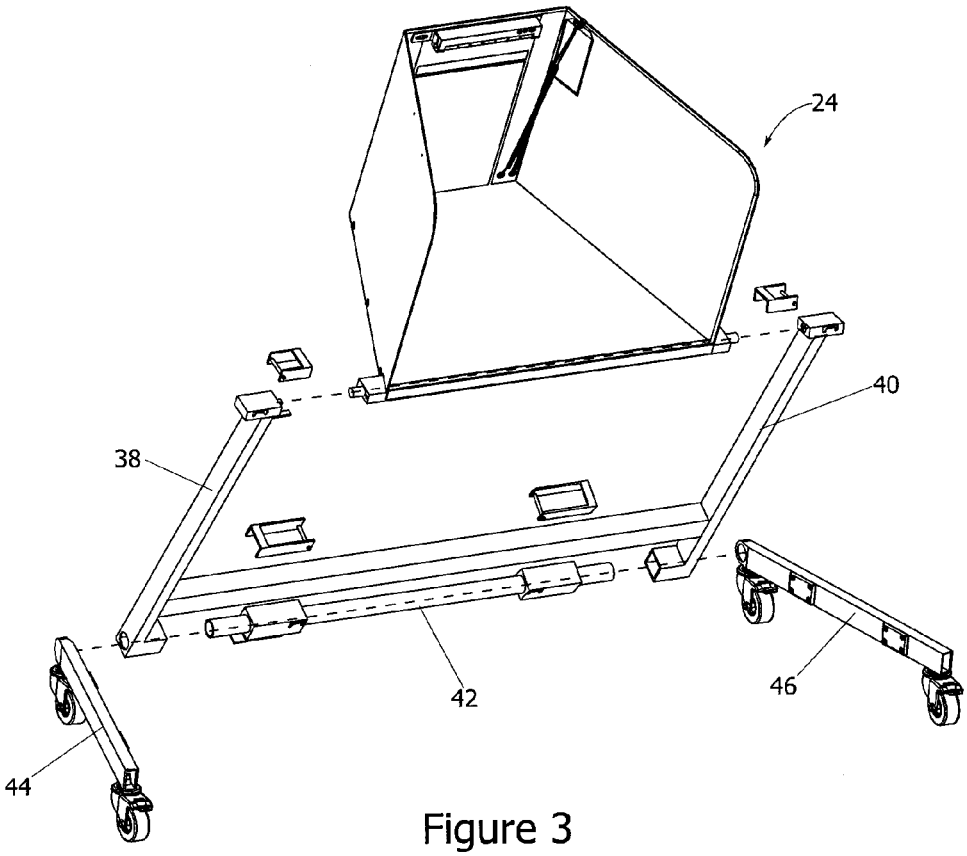
FIG. 3 is an exploded view of the multi-purpose, adjustable voting booth of the present invention.
Figure 4:
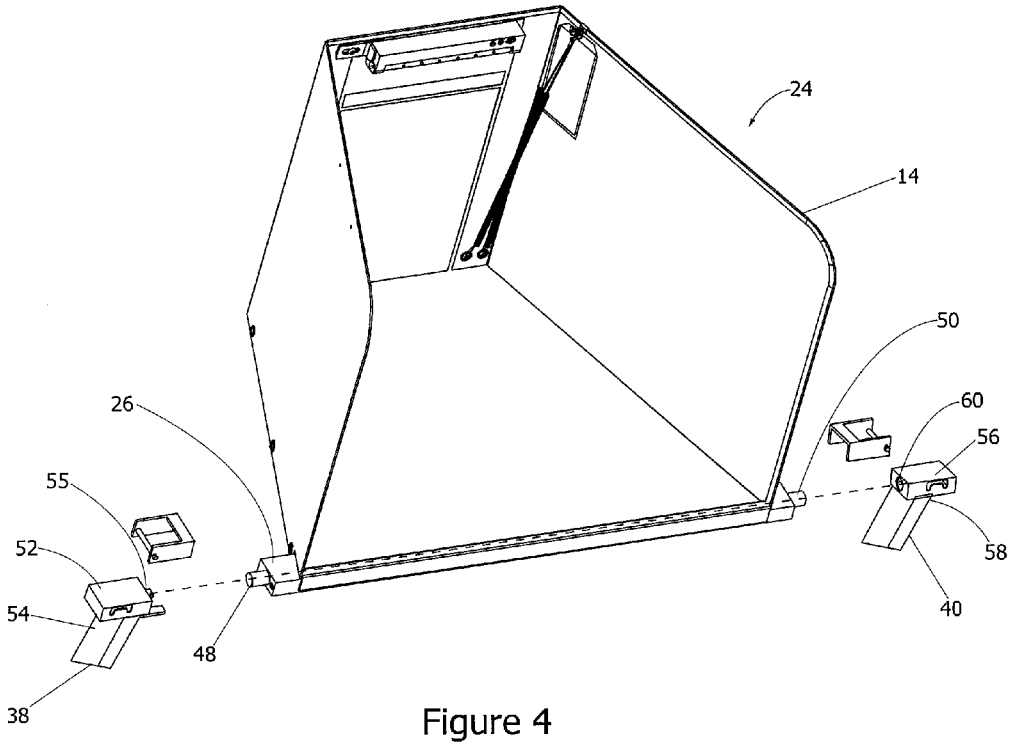
FIG. 4 is a partial exploded view of the multi-purpose, adjustable voting booth of the present invention, illustrating the privacy booth of the present invention.
Figure 5:
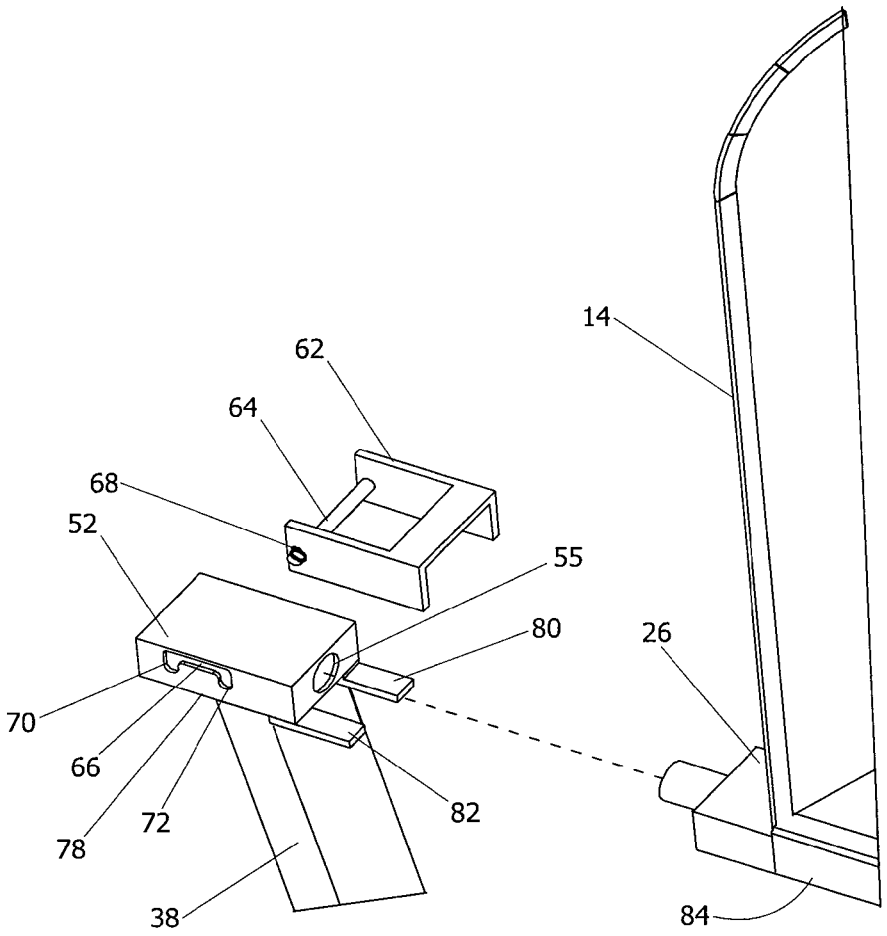
FIG. 5 is a close up perspective view of the top end of the right vertical frame.
Figure 18:
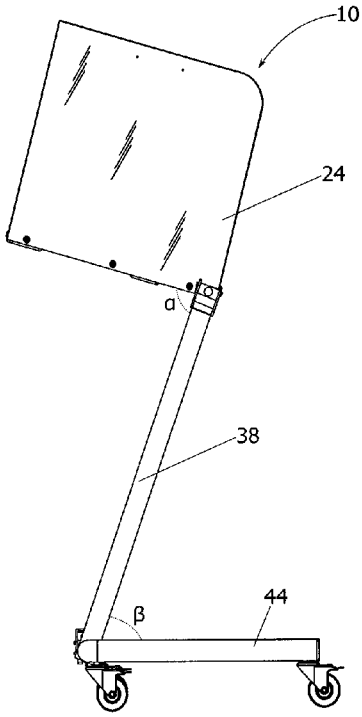
FIG. 18 is a side view of the multi-purpose adjustable voting booth of the present invention shown in the standard configuration.

Referring specifically to FIGS. 3-5, the booth support frame 26 is shown having a generally rectangular shape. The booth support frame 26 contains cylindrical members 48 and 50 which are sized and shaped to fit within the openings positioned within the left vertical frame 38 and the right vertical frame 40. The left vertical frame 38 contains a booth support frame receiving member, illustrated herein as a left vertical frame member 52 coupled to the top end 54 of the frame 38. The left vertical frame member 52 also forms the upper left locking member. Opening 55 is sized and shaped to receive cylindrical member 48. The right vertical frame 40 also contains a booth support frame receiving member, illustrated herein as a right vertical frame member 56 coupled to the top end 58 of the right vertical frame 40. The right vertical frame member 58 also forms the upper right locking member. Opening 60 is sized and shaped to rotatably receive cylindrical member 50. Insertion of the cylindrical members 48 and 50 within openings 55 and 60 rotatably secure the booth support frame 26 to the left vertical frame 38 and the right vertical frame 40, and provides a pivot point. Rotation of the booth support frame 26 allows the privacy booth 24 to rotate at various degrees, $\alpha$, see FIGS. 18 and 19.

Figure 20:
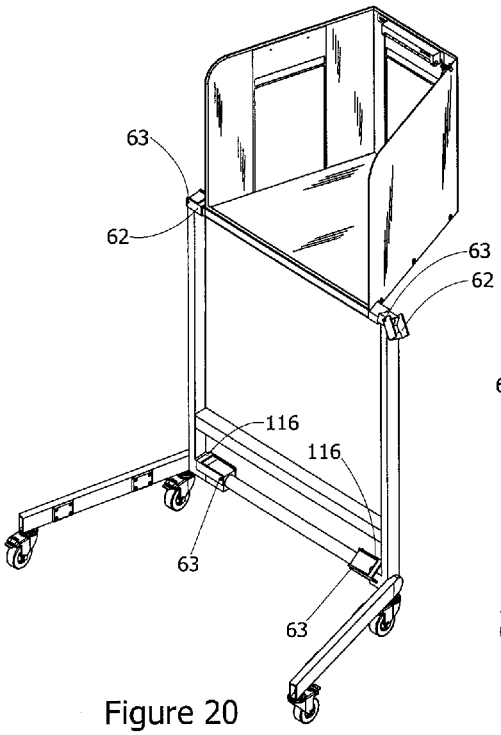
FIG. 20 is a front perspective view of an alternative embodiment of the multi-purpose adjustable voting booth of the present invention shown in the standard configuration and having alternative brackets.
Figure 21:
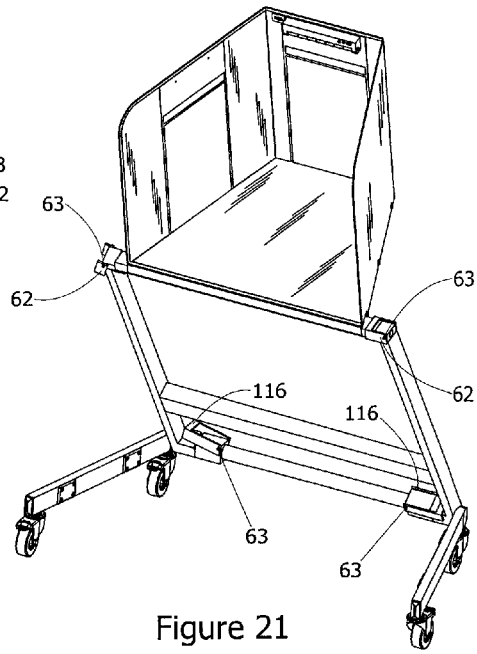
FIG. 21 is a front perspective view of the alternative embodiment of the multi-purpose adjustable voting booth illustrated in FIG. 20, shown in the ADA complaint configuration.
Figure 22:
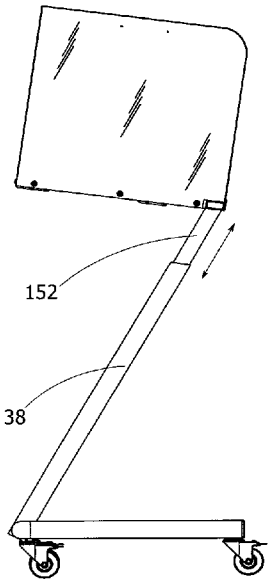
FIG. 22 is a side view of an alternative embodiment of the multi-purpose adjustable voting booth of the present invention, shown in the regular configuration with alternative mechanisms for height and width adjustment.
Figure 23:
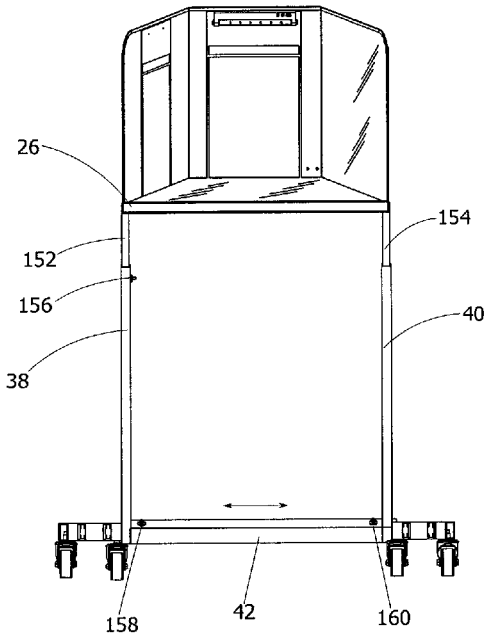
FIG. 23 is a front view of the alternative embodiment of the multi-purpose adjustable voting booth illustrated in FIG. 22.
Figure 24:
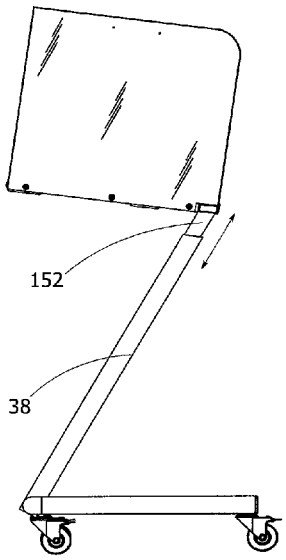
FIG. 24 is a side view of the alternative embodiment of the multi-purpose adjustable voting booth illustrated in FIG. 22, shown in the ADA compliant configuration.
Figure 25:
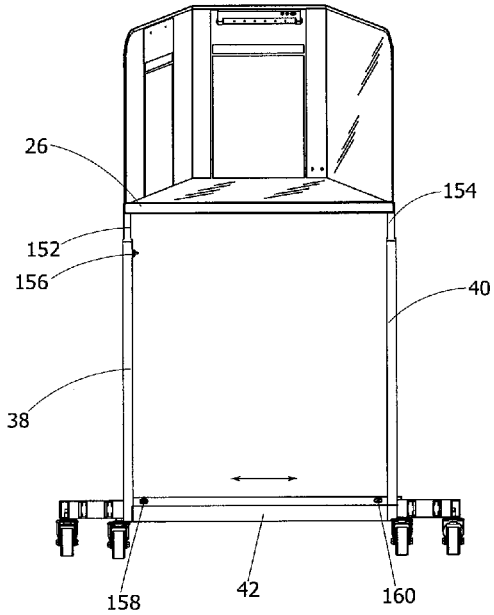
FIG. 25 is a front view of the alternative embodiment of the multi-purpose adjustable voting booth illustrated in FIG. 24.
Figure 26:
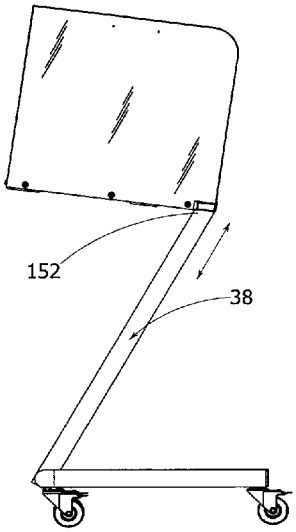
FIG. 26 is a side view of an alternative embodiment of the multi-purpose adjustable voting booth configuration, illustrated in ADA compliance, having width adjustment capability.
Figure 27:
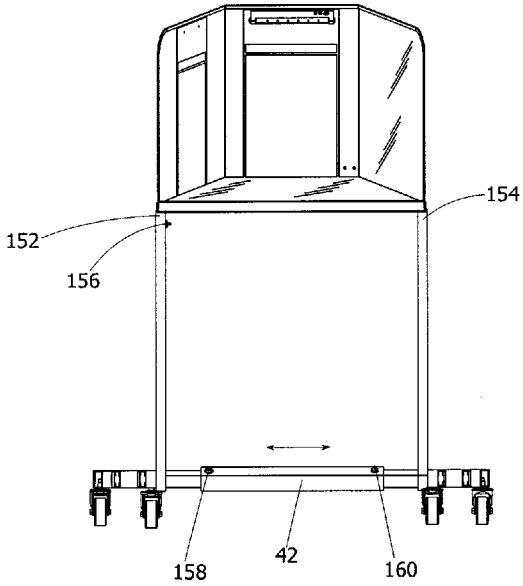
FIG. 27 is a front view of the alternative embodiment of the multi-purpose adjustable voting booth configuration illustrated in FIG. 26.
Figure 28:
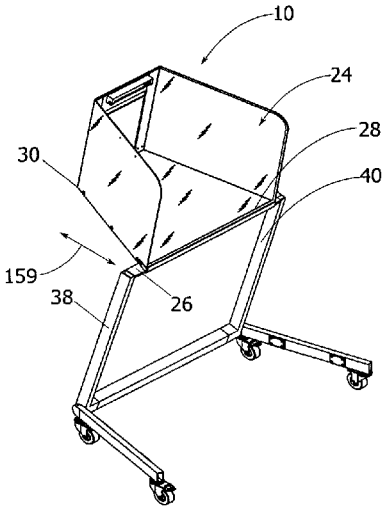
FIG. 28 is a front perspective view of an alternative embodiment of the multi-purpose adjustable voting booth having a slideably adjustable privacy booth.
Figure 29:
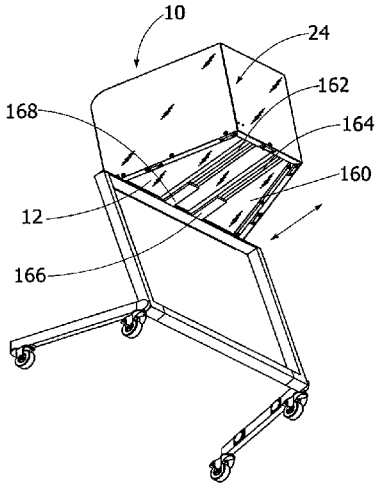
FIG. 29 is a bottom perspective view of the alternative embodiment of the multi-purpose adjustable voting booth illustrated in FIG. 28, showing the privacy booth in the fully backward deployed position.
Figure 30:
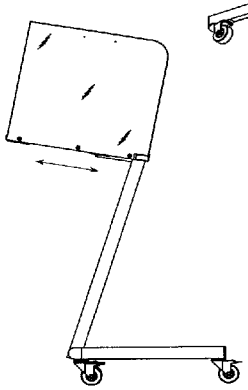
FIG. 30 is a side view of the alternative embodiment of the multi-purpose adjustable voting booth illustrated in FIG. 29.
Figure 31:
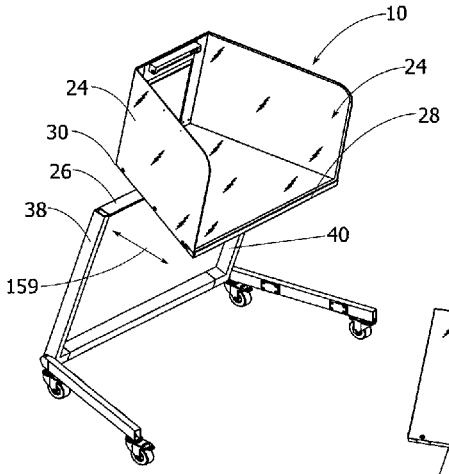
FIG. 31 is a front perspective view of an alternative embodiment of the multi-purpose adjustable voting booth illustrated in FIG. 28, shown in an ADA compliant configuration having the privacy assembly deployed fully forward.
Figure 32:
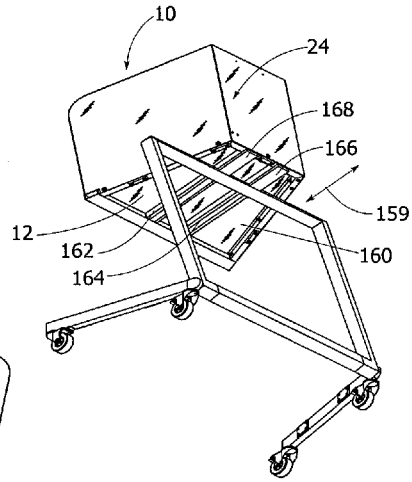
FIG. 32 is a bottom perspective view of the alternative embodiment of the multi-purpose adjustable voting booth illustrated in FIG. 31.
Figure 33:
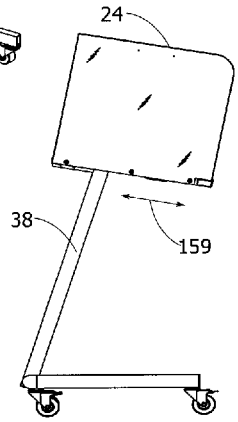
FIG. 33 is a side view of the alternative embodiment of the multi-purpose adjustable voting booth illustrated in FIG. 32.
Figure 34A:
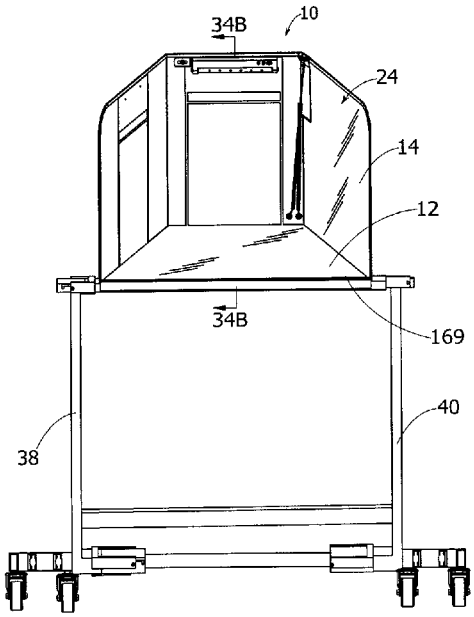
FIG. 34A is a front perspective view of the multi-purpose adjustable voting booth of the present invention, illustrating the anti-slip surface or edge.
Figure 34B:
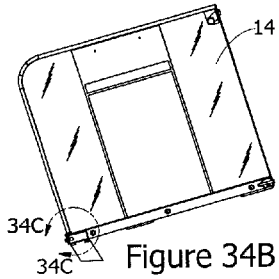
FIG. 34B is a partial side view of the multi-purpose adjustable voting booth illustrated in FIG. 34A.
Figure 34C:
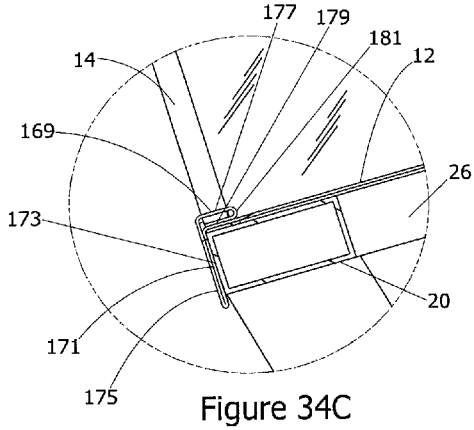
FIG. 34C is an enlarged view of section 34C illustrated in FIG. 34B and showing the anti-slip surface/edge.
Figure 35A:
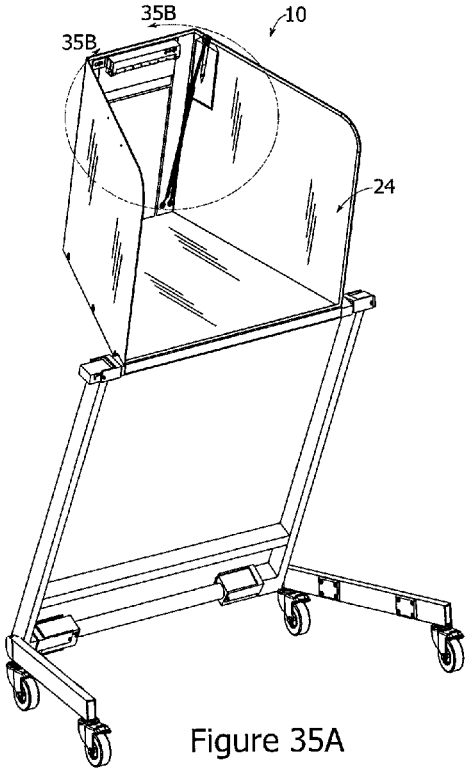
FIG. 35A is a front perspective view of the multi-purpose adjustable voting booth of the present invention showing additional features within the privacy booth.
Figure 35B:
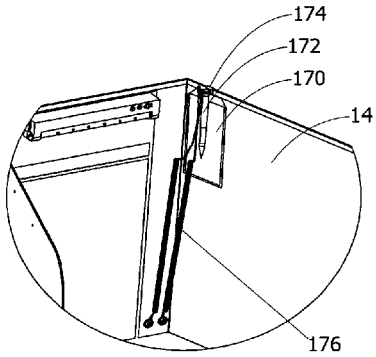
FIG. 35B is an enlarged view of section 35B illustrated in FIG. 35A.
Figure 36A:
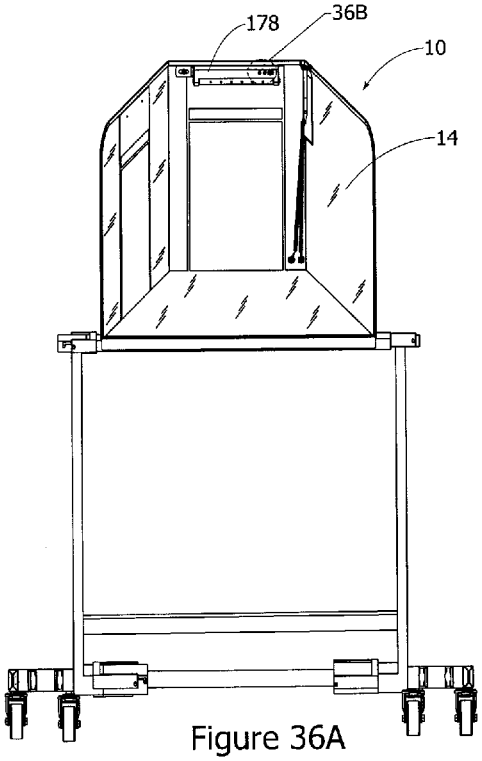
FIG. 36A is a front perspective view of the multi-purpose adjustable voting booth of the present invention showing LED control functionality.
Figure 36B:
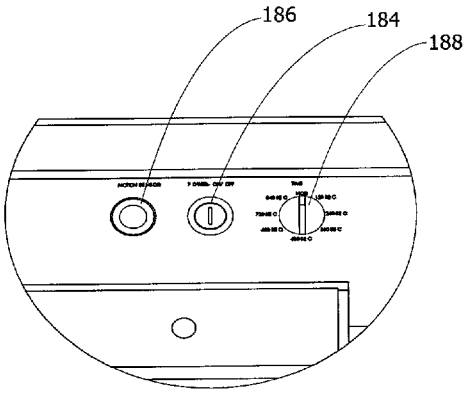
FIG. 36B is an enlarged view of section 36B illustrated in FIG. 36A.
Figure 37A:
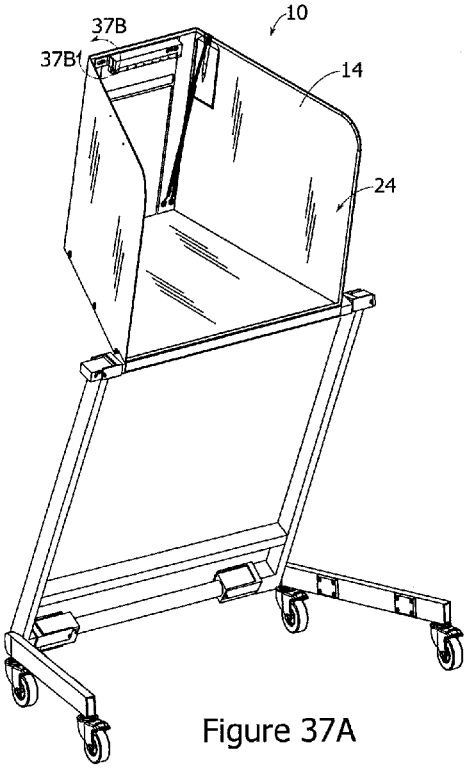
FIG. 37A is a front perspective view of the multi-purpose adjustable voting booth of the present invention showing a mounting arrangement for attaching the LED light to the privacy booth.
Figure 37B:
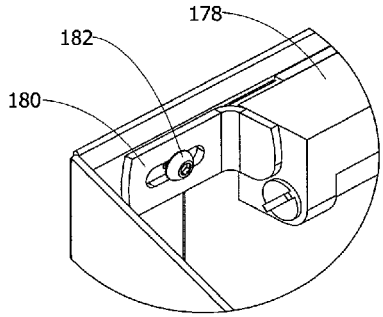
FIG. 37B is an enlarged view of section 37B illustrated in FIG. 37A.

To prevent unintended or too much rotation, each of the vertical frames 38 and 40 contain one or more mechanisms to prevent such movement. For example, the left vertical frame 38 (or right vertical frame 40) each contain a slide bracket 62 which couples to the booth support frame receiving member 52 (or 56 booth support frame receiving member). The slide bracket 62 contains a pin member 64 which engages a U-shaped slot 66 located within two opposing sides of the left vertical booth support frame receiving member 52 (or member 56). The pin 64 is secured to the slide bracket 62 via clips 68 which rest within a channel (not illustrated) formed within the pin 64. Moving the slide bracket 62 up so that pin member 64 traverses between each end 70 and 72 of the U-shaped slot 66 allows the bracket to extend over or retract from a portion of the booth support frame 26. When the pin 64 is placed in either end portion 70 or 72, it is prevented from moving, thereby placing the slide bracket in a fixed position. FIGS. 20 and 21 illustrate an alternative embodiment of the bracket 62 which does not slide but rather pivots upon pin 63.

Figure 7:
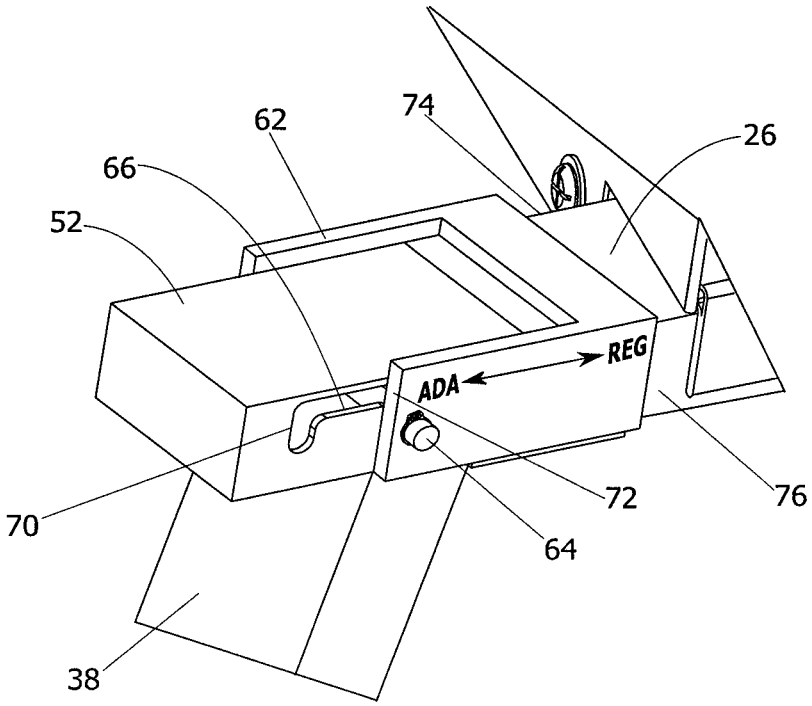
FIG. 7 is a perspective view of the upper left vertical frame locking member illustrated in a locked position.
Figure 8:
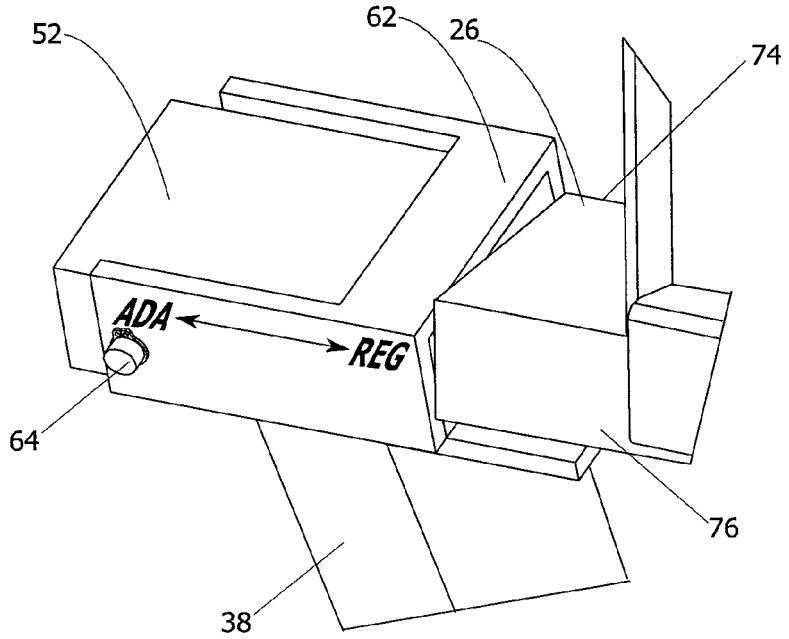
FIG. 8 is a perspective view of the upper left vertical frame locking member illustrated in an unlocked position.
Figure 17B:
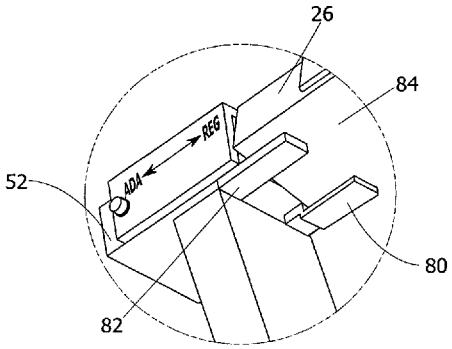
FIG. 17B is an enlarged section of 17B illustrated in FIG. 17A, showing additional swivel angle limiting devices in accordance with the instant invention.
Figure 17C:
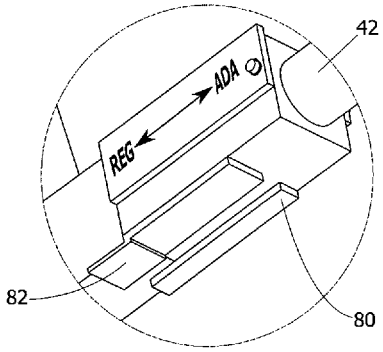
FIG. 17C is an enlarged section of 17C illustrated in FIG. 17A, showing additional swivel angle limiting devices in accordance with the instant invention.

Referring to FIG. 7, the slide bracket 62 is shown in a locked position with the pin 64 being secured to the end portion 72 of the U-shaped slot 66. In this arrangement, the slide bracket 62 is secured over opposing sides 74 and 76 of the booth support frame 26, thereby preventing any rotational movement. To place the slide bracket in an unlocked position, the slide bracket 62 is lifted upwardly and moved so that the pin 64 rests within the end portion 70 of the U-shaped slot 66, see FIG. 8. In the unlocked position, the slide bracket 62 is no longer in contact with the opposing sides 74 and 76 of the booth support frame 26. This positioning allows the booth support frame 26 to rotate using the vertical frame receiving member as a pivoting point. To prevent the booth support frame 26 from rotating too far from a pre-determined distance, each of the booth support frame receiving members 52 and 56 have one or more rotation stop members 80 and 82 positioned on the bottom surfaces, see FIG. 5. The rotation stop members 80 and 82 are shown as finger-like extensions attached to the bottom surface 78 of the booth support frame receiving members 52, see also FIGS. 16A-C and 17A-C. The rotation stop members 80 and 82 are sized so that they are engageable with the bottom face 84 of the booth support frame 26, thereby maintaining the booth support frame 26 in a generally parallel and flush arrangement with the booth support frame receiving member 52 when in a non-rotated position and preventing rotation past a pre-determined position. Preferably, the rotation stop members 80 and 82 are in a misaligned or staggered alignment. As shown in FIG. 17B, rotation stop member 80 has a reverse Z-shape configuration which allows it to be positioned lower than that of rotation stop member 82. Once the booth support frame 26 is rotated a predetermined angle, it contacts the rotation stop members 82, thereby preventing any further rotation. Rotation in the opposite direction past a pre-determined angle allows contact with the other rotation stop member 80, thereby preventing unwanted rotation in the opposite direction.

Figure 6:
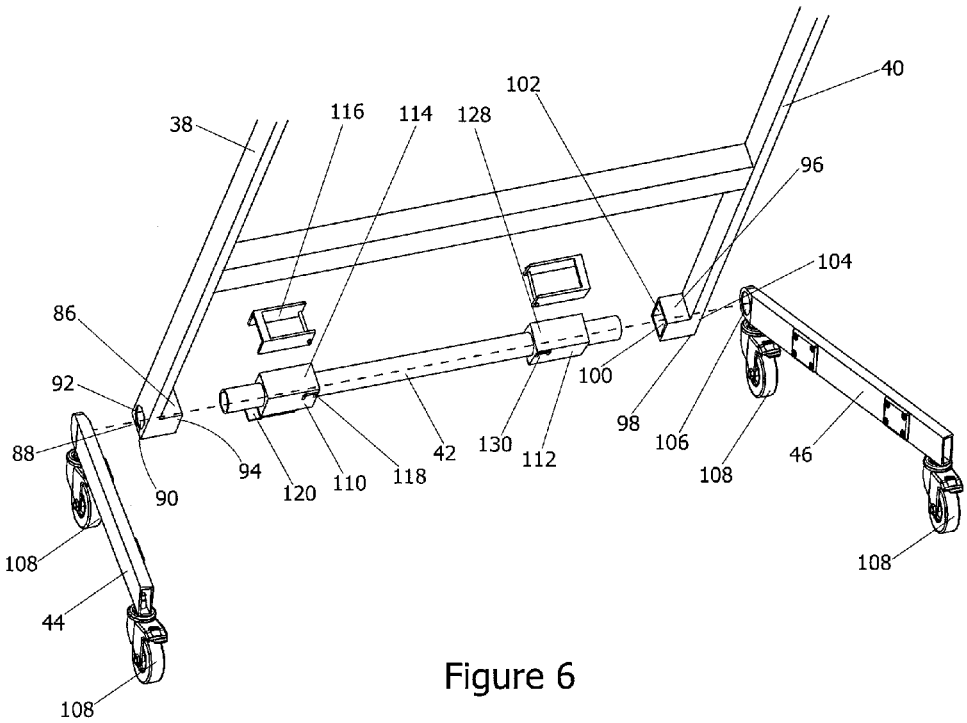
FIG. 6 is a partial exploded view of the multi-purpose, adjustable voting booth of the present invention, illustrating the support frame.

Referring to FIG. 6, the left vertical frame 38 contains a support structure horizontal frame receiving member 86 at the bottom end 88 of the frame 38. The support structure horizontal frame receiving member 86 contains a passageway 90 defined by the space in between a first opening 92 and a second opening 94. Passageway 90 is sized and shaped to receive the support structure horizontal frame 42, shown in the illustrative embodiment as a cylindrical bar. A portion of the support structure horizontal frame 42 is placed into opening 94, extending through the passageway 90, and out past opening 92. The portion that extends through the opening 92 is inserted into an opening (not shown) positioned on the left bottom base support frame 44. Once in place, the left bottom base support frame 44 can be coupled to the support structure horizontal frame 42 through any known coupling mechanism, such as through welding. The right vertical frame 40 contains a right support structure horizontal frame receiving member 96 at the bottom end 98 of the frame 40. The right support structure horizontal frame receiving member 96 contains a passageway 100 defined by the space in between a first opening 102 and a second opening 104. Passageway 100 is sized and shaped to receive a portion of the opposite end of the support structure horizontal frame 42. The opposing portion of the support structure horizontal frame 42 extends through opening 102, into the passageway 100 and extends out past opening 104. The portion that extends through the opening 104 is inserted into an opening 106 positioned on the right bottom base support frame 46. Once in place, the right bottom base support frame 46 can be coupled to the support structure horizontal frame 42 through any known coupling mechanism, such as welding. Attached to the left bottom support frame 44 and the right bottom support frame 46 are one or more castors 108, such as a ball bearing enclosed dual front operable brake castor, which allows the voting booth 10 to be easily moved. Each of the castors is strategically placed to provide structure stability.

Figure 9:
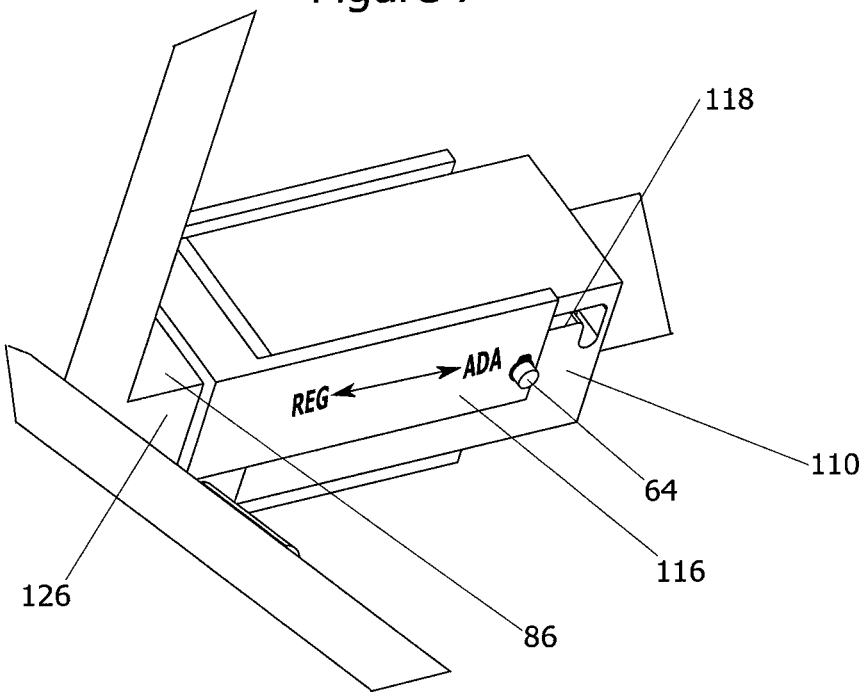
FIG. 9 is a perspective view of the lower left locking member illustrated in a locked position.
Figure 10:
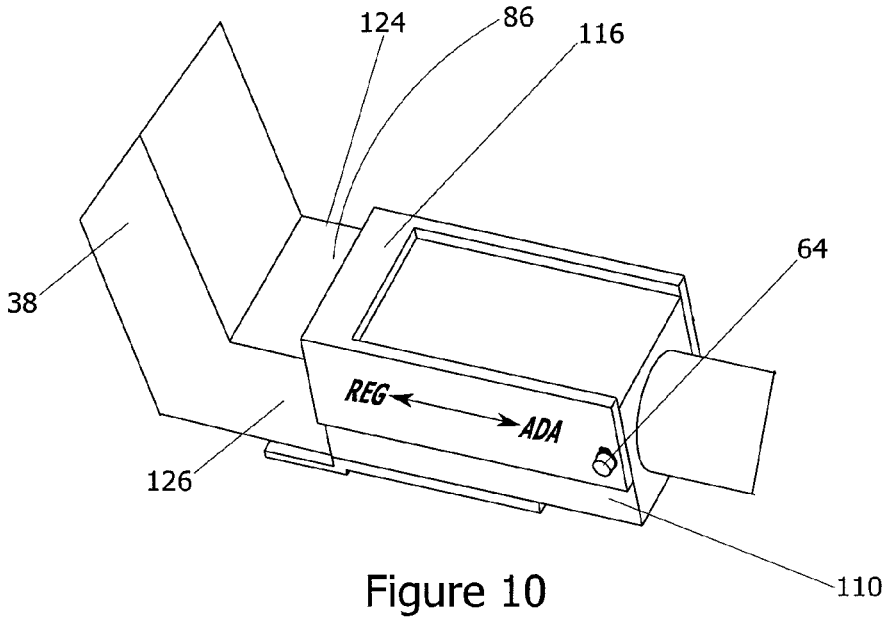
FIG. 10 is a perspective view of the lower left locking member illustrated in an unlocked position.

Positioned along the support structure horizontal frame 42 is locking members 110 and 112 (see FIG. 6). The left lower locking member 110 contains a base member 114, shaped in a generally rectangular configuration having a plurality of sides forming surface faces. A slide bracket 116 having the same features and functionality as slide bracket 62 couples to U-shaped channels 118 formed in two opposing sides. Attached to the bottom side of the base member 114 are rotation stop members 120 and 122 (122 not illustrated) designed and functioning as described for rotation stop members 80 and 82. Referring to FIG. 9, the locking member 110 is shown in the locked configuration in which the slide bracket 116 is engaged with the opposing surfaces 124 and 126 of the support structure horizontal frame receiving member 86. Lifting the slide bracket 116 and sliding to the right so that the pin 64 rests within the opposing end of the U-shaped channel 118, allows the slide bracket 116 to be placed in the unlocked position in which the bracket no longer engages or contacts the opposing sides 124 and 126, see FIG. 10. The locking member 112 contains the same features and functions in the same manner as that of locking member 110. The locking member 112 contains a base member 128, shaped in a generally rectangular configuration having a central opening to allow engagement with structure 42 and a plurality of sides forming surface faces. A slide bracket 116, having the same features and functionality as slide bracket 62 couples to the U-shaped channels 130 formed in two opposing sides. Attached to the bottom side of the base 124 are rotation stop members, not shown. FIGS. 20 and 21 illustrate an alternative embodiment of the bracket 116. The bracket 116 is not slidable, but is hingedly connected through pin 129.

The right bottom base support frame 46 is welded to the support structure horizontal frame 42. Since the left bottom base support frame 44 is welded to the support structure horizontal frame 42, a single unit is formed. The left bottom base support frame 44 and the right bottom base support frame 46 are arranged in a non-parallel manner, preferably arranged to extend in a direction opposite, or away from the privacy booth stand 24. Preferably, the single unit is arranged so that the left bottom base support frame 44 and the right bottom base support frame 46 form acute angles with the support structure horizontal frame 42. While formed as a single unit, the left and right vertical frames 36 and 38 are rotatable about the pivot points formed by connection of the vertical frames, bottom support frames, and the horizontal frame. By moving one or both of the vertical frames, and changing the angle β, see FIGS. 18 and 19, the distance between the privacy booth 24 and the surface in which the voting booth 10 rests decreases, thereby providing vertical adjustment. Moving the frames in the opposite direction allows the distance between the two points to return back to the starting point, or anywhere in between.

Figure 43:
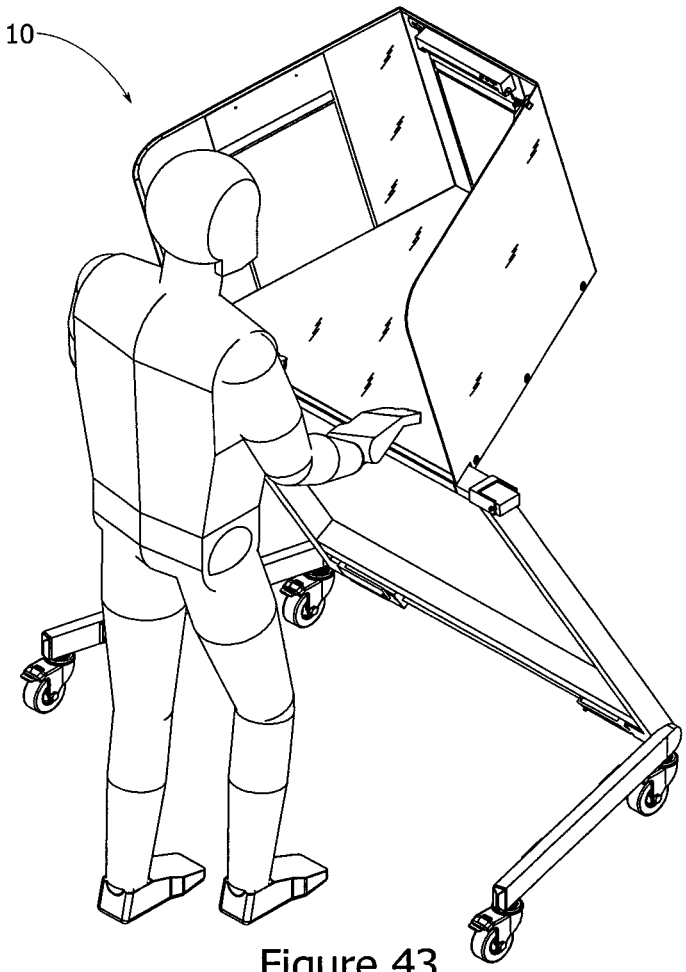
FIG. 43 is a perspective view of the multi-purpose adjustable voting booth of the present invention shown with an individual accessing the voting booth when arranged in the standard configuration.
Figure 44:
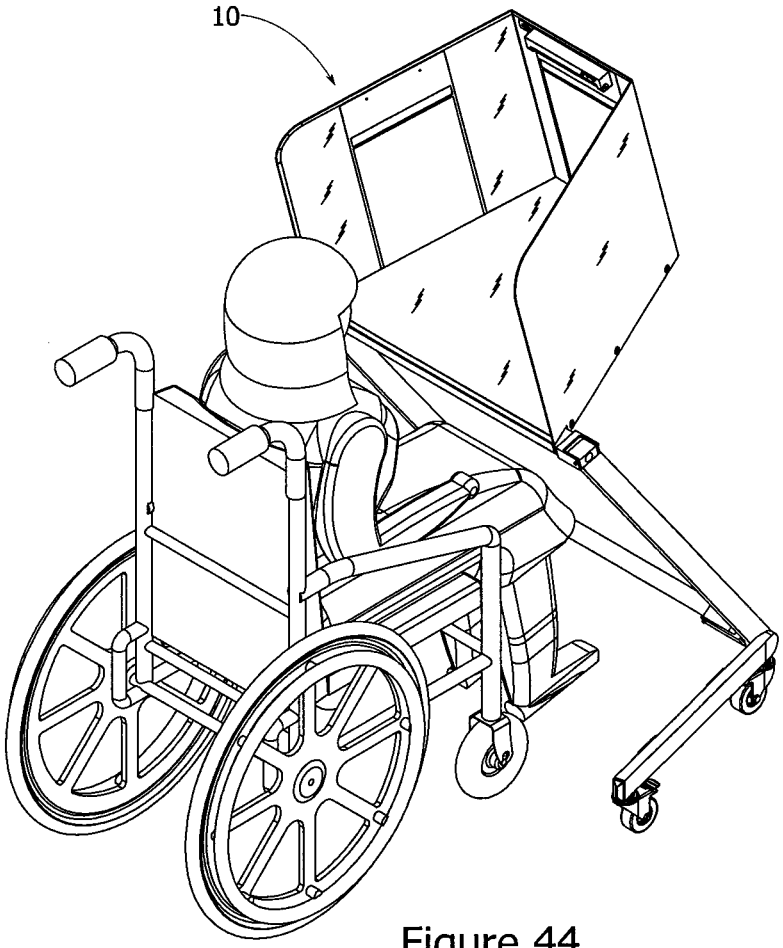
FIG. 44 is a perspective view of the multi-purpose adjustable voting booth of the present invention shown with a wheel chair bound individual accessing the voting booth when arranged in the ADA complaint configuration.

Referring to FIGS. 11A-12C, the voting booth 10 is shown in a standard configuration. In this configuration, the positioning of the privacy booth 24 is at a height off the ground to allow the average sized person to comfortably use the voting booth 10 (see FIG. 43). For those individuals that are taller than the standard sized person, bending or leaning forward allows them to use the device as well. In this manner, a wide range of differently sized individuals can use the voting booth 10 in this position. The upper base frame assembly and the left bottom base support frame 44 and right bottom base support frame 46 can be arranged at a distance that maintains the voting booth 10 center of gravity. The voting booth 10 provides for a control mechanism in which the standard position is achieved by allowing the left side pivoting points to remain in the locked position while the right side pivoting points remain in the unlocked position. Referring specifically to FIG. 11B, the top left slide bracket 62 is shown in the locked position. A portion of the slide bracket 62 is engaged with opposing sides 74 and 76 of the booth support frame 26. In this configuration, the booth support frame 26 can not be rotated. Referring to FIG. 11C, the left bottom side slide bracket is shown in the locked position. The front surface 132 of the base member 114 aligns with and is substantially flush with the front surface 134 of the support structure horizontal frame receiving member 86. The slide bracket 116 engages opposing sides 136 and 138 of the base member 114 to prevent movement.

Figure 12A:
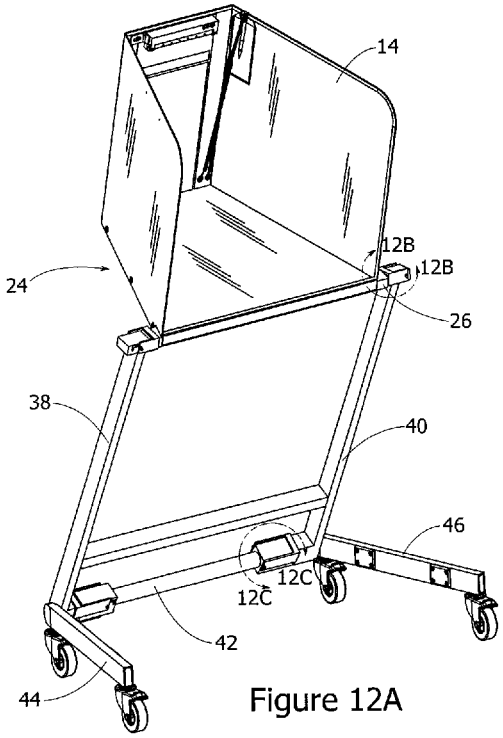
FIG. 12A is a perspective view of the multi-purpose adjustable voting booth of the present invention shown in a standard configuration.
Figure 12B:
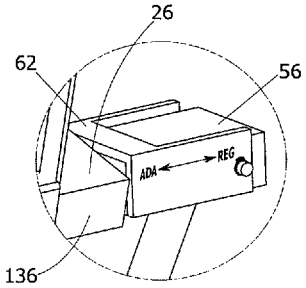
FIG. 12B is an enlarged section of 12B illustrated in FIG. 12A, showing the upper right locking member in an unlocked position.
Figure 12C:
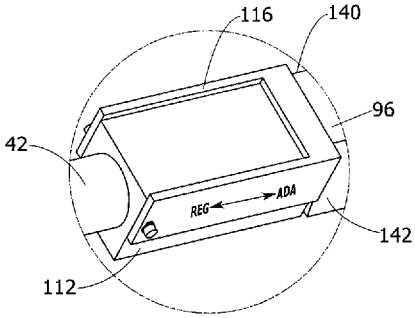
FIG. 12C is an enlarged section of 12C illustrated in FIG. 12A showing the lower right locking member in an unlocked position.

FIGS. 12A, 12B, and 12C illustrate the right upper and lower slide brackets in the unlocked position. Referring specifically to FIG. 12B, the upper right slide bracket 62 is shown in the unlocked position. In this position, the slide bracket 62 is not engaged with opposing sides 136 and 138 (not illustrated) of the booth support frame 26. Referring to FIG. 12C, the lower right side slide bracket is shown in the unlocked position. As shown in the Figure, the slide bracket 116 is not in contact with opposing sides 140 and 142 of the support structure horizontal frame receiving member 96.

Figure 11A:
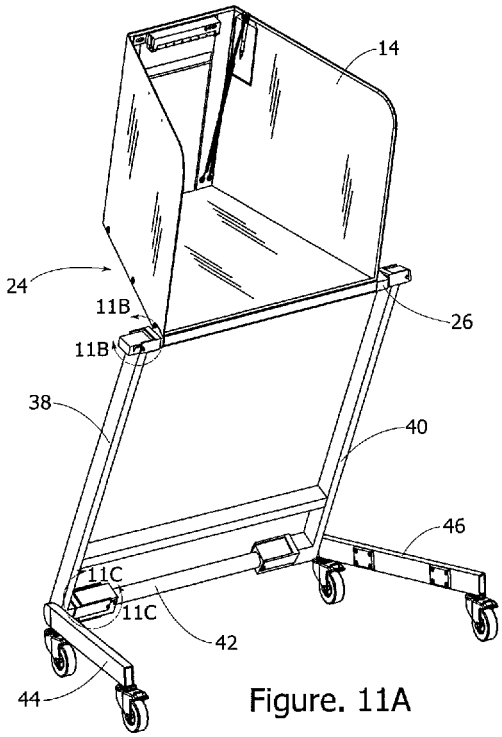
FIG. 11A is a perspective view of the multi-purpose adjustable voting booth of the present invention shown in a standard configuration.
Figure 11B:
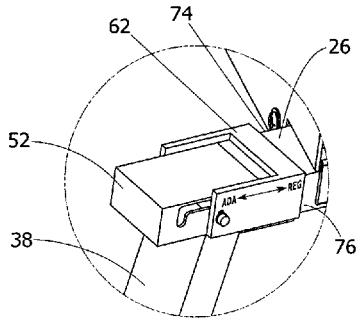
FIG. 11B is an enlarged section of 11B shown in FIG. 11A, illustrating the upper left bracket in a lock position.
Figure 11C:
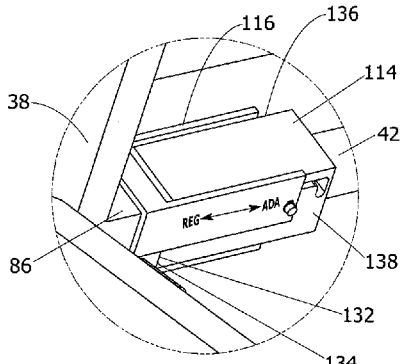
FIG. 11C is an enlarged section of 11C shown in FIG. 11A, illustrating the lower left bracket in a locked position.

FIGS. 13A-14C illustrate the voting booth 10 adjusted to a configuration in which the privacy booth 24 is positioned at a distance which is closer to the ground than that illustrated in FIGS. 11A and 12C. In this configuration, the voting booth 10 complies with ADA regulations and allows voters who are wheelchair bound the ability to comfortably use the voting booth in a similar manner as individuals who are not bound by a wheel chair would use the standard sized voting booth. To provide for such functionality, the user simply locks/unlocks the locking mechanism and moves the left and right vertical frames 38 and/or 40 downward, in the direction of arrows 144 and 146 causing rotation along the pivot points, and moving the privacy booth 24 closer to a handicapped user, see FIG. 13A. In addition to moving the privacy booth 24 closer to the ground, the voting booth may further need adjustment so that the privacy booth 24 rests at a usable angle. To provide a proper angle, the booth support frame 26 is moved in the direction of arrows 148 and 150, thereby changing the angle $\alpha$.

Figure 13A:
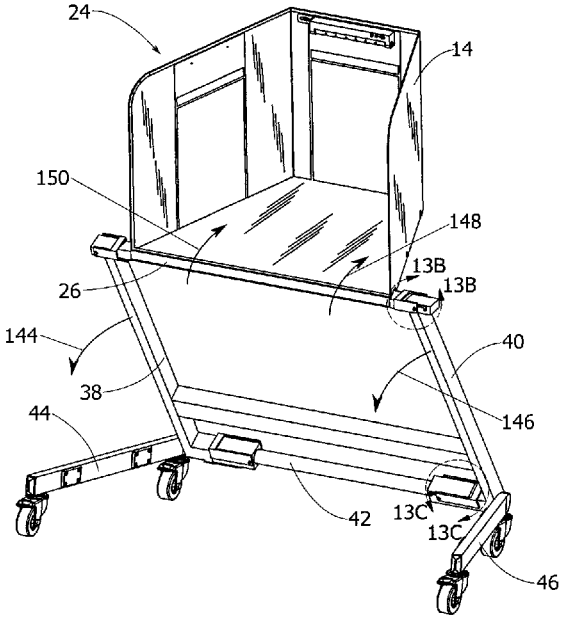
FIG. 13A is a perspective view of the multi-purpose adjustable voting booth of the present invention shown in a second configuration which is ADA compliant.
Figure 13B:
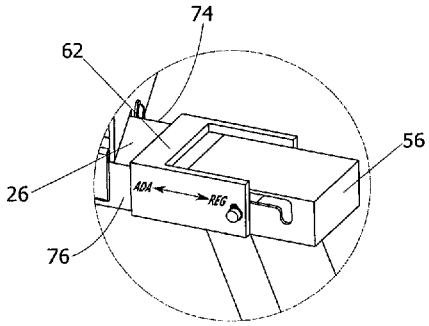
FIG. 13B is an enlarged section of 13B illustrated in FIG. 13A, showing the upper right locking member in a locked position.
Figure 13C:
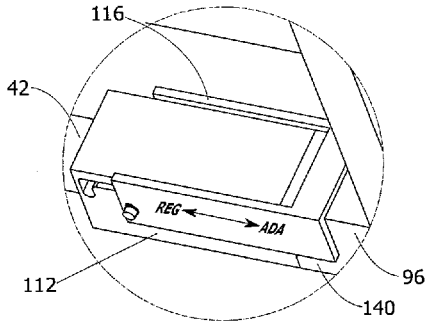
FIG. 13C is an enlarged section of 13C illustrated in FIG. 13A, showing the lower right locking member in a locked position.
Figure 14A:
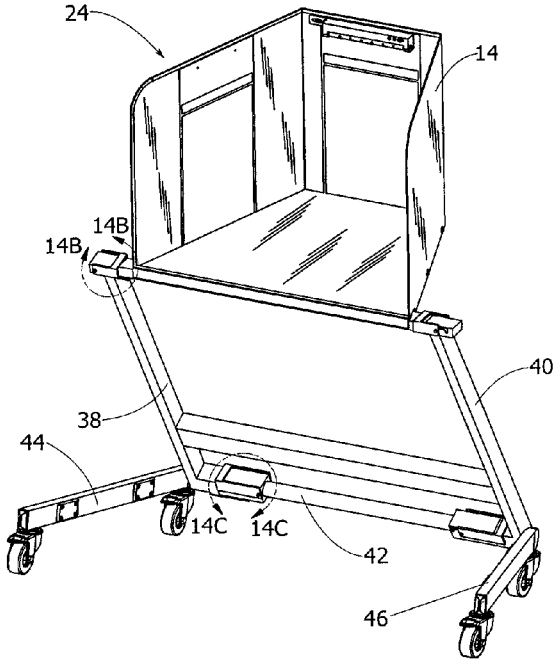
FIG. 14A is a perspective view of the multi-purpose adjustable voting booth of the present invention shown in a second configuration which is ADA compliant.
Figure 14B:
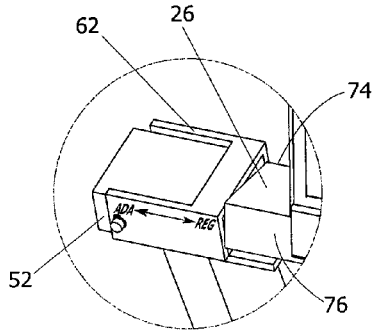
FIG. 14B is an enlarged section of 14B illustrated in FIG. 14A, showing the upper left locking member in an unlocked position.
Figure 14C:
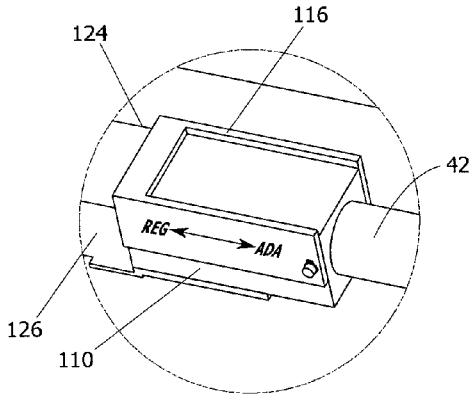
FIG. 14C is an enlarged section of 14C illustrated in FIG. 14A, showing the lower left locking member in an unlocked position.

Referring specifically to FIGS. 13B and 14B, the upper right side slide bracket 62 is now shown in the locked position (see 13B, bracket 62 in contact with the opposing surfaces 74 and 76 of the booth support frame 26) and the top left side bracket 62 is shown in the unlocked position (see 14B, no contact with opposing sides opposing surfaces 74 and 76 of the booth support frame 26). Referring to FIGS. 13C and 14C, the bottom right side bracket 116 is shown in the locked position (bracket 116 in contact with opposing sides 140 and 142 (not shown) of right support structure horizontal frame receiving member 96) and the bottom left side bracket is shown in the unlocked position (bracket 116 is not in contact with the opposing sides 124 and 126 of the left support structure horizontal frame receiving member 86).

The voting booth 10 is preferably arranged so that one side remains in the locked position while the other side is in the unlocked position. When a second configuration is desired, the user simply unlocks the locked side, moves the rotatable parts of the structure, and locks the opposing locking members. Referring to FIG. 15A, the voting booth contains all the same features as described previously and includes an optional second support structure horizontal frame 127 attached to the vertical frames 38 and 40, preferably through welding. The right side upper and lower sliding brackets 62 and 116 are utilized for locking the device when in the ADA compliant configuration. Such arrangement allows the user to switch configurations quickly and easily. The arrangement in which one side can be placed in the locked configuration while the other side remains in the unlocked configuration is the result of the locking members being arranged either in a non-parallel, off-center alignment or opposing locking members having one or more off-centered, non-parallel aligned faces, sides, or surfaces.

Figure 15B:
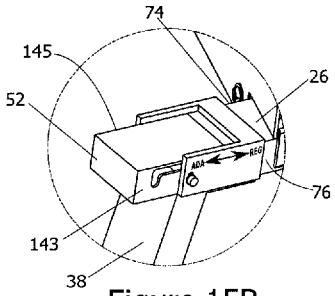
FIG. 15B is an enlarged section of 15B illustrated in FIG. 15A.
Figure 15C:
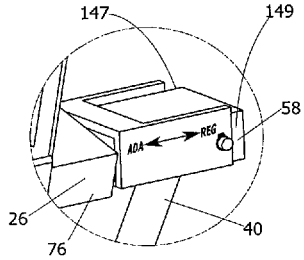
FIG. 15C is an enlarged section of 15C illustrated in FIG. 15A.
Figure 15A:
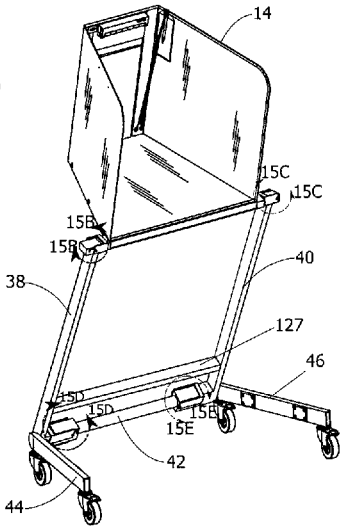
FIG. 15A is a perspective view of the multi-purpose, adjustable voting booth of the present invention illustrating the plurality of locking members in an off-centered alignment.

Referring to FIG. 15B, the left vertical booth support frame receiving member 52 which forms the upper left locking member is illustrated having one or more off-centered, non-parallel aligned surfaces with respect to the alignment of one or more surfaces of the right vertical frame receiving member 58 (shown in FIG. 15C) which forms the upper right locking member. In this non-parallel arrangement, vertical booth support frame receiving members 52 and 58 are arranged so that one or more surfaces or faces of one of vertical booth support frame receiving members is oriented at different angles relative to the opposing member so that as the booth support frame 26 is placed in one position, the vertical booth support frame receiving member 52 can be locked in place. The opposing sides 74 and 76 are flush or in the same plane as opposing sides 143 and 145 of the vertical booth support frame receiving member 52. FIG. 15C shows the right vertical frame receiving member 58 being out of plane with the booth support frame 26 so that surfaces 74 (not shown) and 76 are not flush or are out of plane with surfaces 147 and 149 of the right vertical frame receiving member 58. Rotating the booth support frame 26 allows the right vertical frame receiving member 58 to be in a flush, planer relationship with the booth support frame 26 in order to be locked while the left vertical frame receiving member 52 forms a non-flush, non-plane relationship with the booth support frame 26. The left lower locking member 110 and the right lower locking member 112 are configured in the same orientation.

Figure 15D:
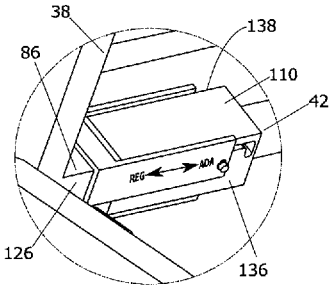
FIG. 15D is an enlarged section of 15D illustrated in FIG. 15A.
Figure 15E:
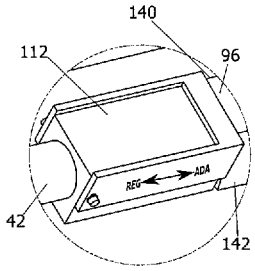
FIG. 15E is an enlarged section of 15E illustrated in FIG. 15A.

As illustrated in FIG. 15D, the left lower locking member 110 is shown in the locked position, in which the opposing surfaces 124 (not shown) and 126 of structure 86 are flush, or in a planar relationship with opposing sides 136 and 138 of structure 110. In this orientation, the right lower locking member 112 is arranged on structure 42 at a different angle than the left lower locking member 110. As shown in FIG. 15E, the right lower locking member 112 is orientated so that opposing sides 140 and 142 of structure 96 is in a non-flush, non-planar relationship. Rotation of structures 38 or 40 allows the right lower locking member 112 to assume a planar relationship with structure 96 and the left lower locking member 110 to assume a non-planar relationship with structure 86. The voting booth 10 can also be constructed so that all the locking members are orientated in the same direction. An additional locking mechanism, such as a pin, may need to be employed so that, in the rotated position, the movable structures cannot be unintentionally rotated.

Referring to FIGS. 22-33, alternative embodiments of the voting booth 10 are shown. The voting booth 10 illustrated in these figures contain all or some of the same features as described above. Referring specifically to FIGS. 22-27, the voting booth 10 is illustrated having vertical adjustment. To achieve such adjustment, the vertical frames 38 and 40 contain telescoping arms 152 and 154 which move relative to vertical frames 38 and 40. Once at a desired position, the telescoping arms 152 and 154 are locked into position through pin 156 (vertical frame 38) and an optional second pin 158 (vertical frame 40, not illustrated). The voting booth 10 may be designed to contain horizontal, or width adjustability, either separately or in combination with the vertical height adjustment. To provide width based adjustment so that the distance between vertical frames 38 and 40 can be adjusted to accommodate wheelchair bound users, the support structure horizontal frame 42 may be made of two independent structures in which one of the structures slides within the other structure. Once a desired width is achieved, the two members are locked in place through use of pins 158 and 160. In this embodiment, the booth support frame 26 is constructed in the same manner as the support structure horizontal frame 42, i.e. having two members slidably engaged with each other and locked in place by one or more pins.

In addition to the adjustability described previously, or as an independent embodiment, the voting booth 10 may be constructed to provide for the privacy booth 24 to be slideably adjustable between a first configuration, a second configuration, or configurations in between, see arrows 159 in FIGS. 28-33. The privacy booths 24 in these configurations are designed to have the capability of forward/backward horizontal movement which is perpendicular to the longitudinal axis of the booth support frame 26. Preferably, the rotatable movement of the booth and the vertical frames are eliminated. The voting booth 10 contains mechanisms that allow horizontal movement positioned at the bottom surface 160 of the usable panel 12, such as slideable channels, ball bearing drawer slides, or other mechanism known to one of skill in the art. For example, two female tracks 162 and 164 which are constructed to slidably interact with male tracks 166 and 168 positioned on and/or extending outwardly from the booth support frame 26, see FIGS. 28-33. The privacy booth 24 can be moved from a first position in which the first edge 28 of the useable panel 12 is aligned with the booth support frame 26 (FIG. 28) to an opposing position in which the rear edge 30 of the usable panel 12 is aligned with the booth support frame 26 (FIG. 31) to any position in between.

Referring to FIGS. 34-40, several features which enhance the user's interaction with the voting booth 10 are shown. FIGS. 34A-C illustrate the attachment of an anti-slip structure 169 attached to the booth support frame 26. The anti-slip structure 169 prevents materials, such as ballot papers, that are placed onto the usable panel 12 from falling to the ground. The anti-slip structure 169 may be attached to the top edge of the usable panel 12 and contains a vertical portion 171 which extends below booth support frame 26 for added strength. Preferably, the anti-slip structure 169 may be formed as an integral piece extending from the usable panel 12 so that the vertical portion 171 is made of a first vertical surface 173 bent to form a second parallel vertical surface 175. The second vertical surface 175 extends to a height above the surface 20 of the usable panel 12. The top end of the second vertical surface 175 is bent to form is a generally u-shape structure having arms 177 and 179 separated by a curved surface 181. The anti-slip structure 169 provides the voting booth 10 with dual front edges, one edge formed from the booth support frame 26 and the second formed by the anti-slip structure, both of which preferably form effective acute angles with opposing sides of upper base frame assembly. Additionally, the anti-slip structure may also provide a grip when moving one or more nested voting booths 10 from one location to a second location.

Figure 38A:
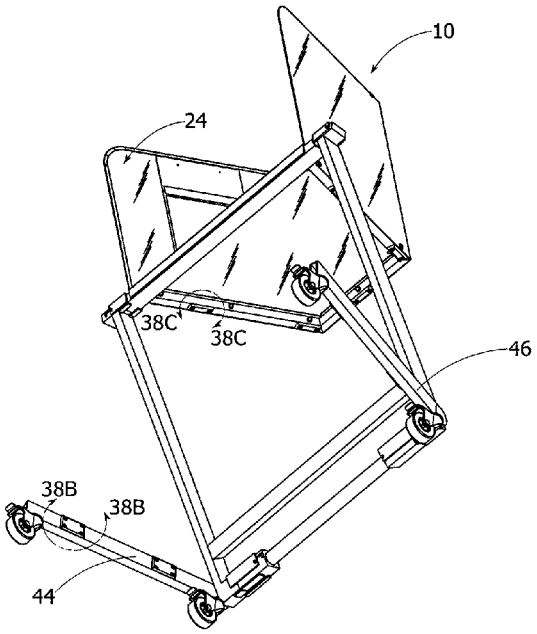
FIG. 38A is a bottom perspective view of the multi-purpose adjustable voting booth of the present invention showing a rubber liner attached to the bottom of the privacy booth and to the left and right base support frames.
Figure 38B:
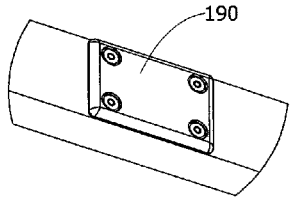
FIG. 38B is an enlarged view of section 38B illustrated in FIG. 38A showing the rubber liner attached to the upper base frame assembly.
Figure 38C:
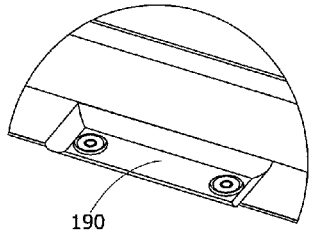
FIG. 38C is an enlarged view of section 38C illustrated in FIG. 38A showing the rubber liner attached to the right/left base support frame.
Figure 39:
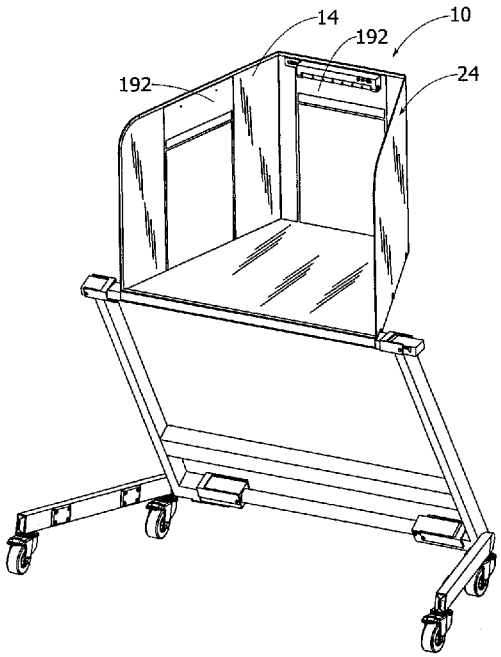
FIG. 39 is a front perspective view of the multi-purpose adjustable voting booth of the present invention showing a pouch attached to the inside front wall and inside side wall of the privacy shield of the privacy booth.
Figure 40:
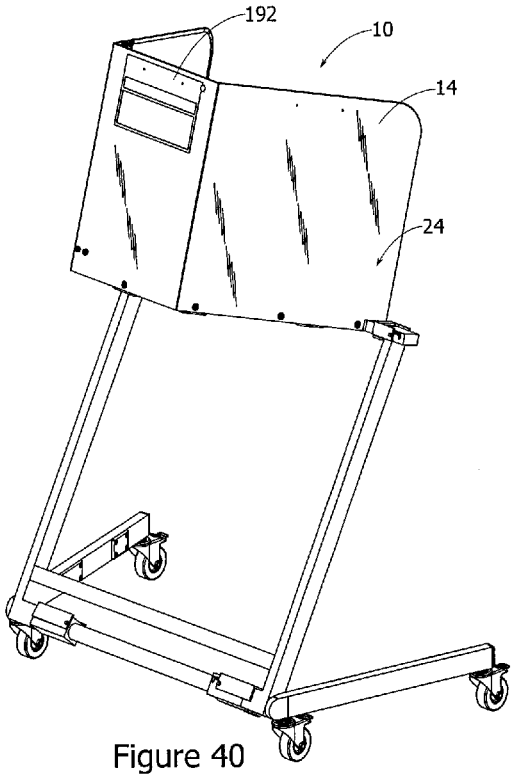
FIG. 40 is a rear perspective view of the multi-purpose adjustable voting booth showing a pouch attached to an outside wall of the privacy shield.

FIGS. 35A-37B illustrate the privacy booth 24 having one or more writing accessories including, for example but not limited to, a magnifier 170 and a writing pen 172 attached to one of the sides 14A, 14B, and/or 14C of the privacy shield 14 through fastening members such as a hook 174 and tether 176. The tether 176 may be attached to the privacy shield 14 through use of screws and nuts, or other fastening means known to one of skill. To provide the user with enhanced viewing capability, the privacy booth 24 may contain a light (see FIG. 37B), such as an LED light 178 secured by bracket mount 180 and screw 182. The LED light 178 may contain an on/off switch 184 (see FIG. 36B) or a motion sensor 186 so that as a person approaches the voting booth 10, the light 178 is activated. A time adjuster button 188 may be used so that after a certain time period of activation, the light turns off. Other control type buttons, such as those that can be used to adjust for brightness may be included as well. Referring to FIGS. 38A-38C, the voting booth 10 may contain one or more rubber liners or plates 190 attached to the one or more structures 16, 18, or 20 (shown in FIG. 17A) of the upper base frame assembly of the privacy booth 24 and/or along one or more portions of the left bottom base support frame 44 and/or the right bottom base support frame 46. The rubber liners or plates 190 prevent scratching or damage to any part of the voting booth 10 that is in contact with like-structured voting booths when in the nested configuration, see FIG. 41. Finally, the privacy booth 24 may contain one or more pouches 192, see FIGS. 39 and 40, attached to the inner and/or outer surfaces of the privacy shield 14 and used to hold materials, such as voting instructions.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A multi-purpose adjustable voting booth adapted for nesting in a second like-shaped voting booth comprising:

a privacy booth structure having a usable panel defined by a front edge, a rear edge, and two opposing side edges, said usable panel being securable to an upper base frame assembly; said privacy booth structure having a privacy shield attached to said usable panel;

a privacy booth support structure for supporting said privacy booth and providing said privacy booth rotatable movement, said privacy booth support structure rotatably attached to a main body support structure for providing angular adjustment to said privacy booth support structure;

said main body support structure having a pair of vertically extending frames, each said vertical frame attached to said privacy booth support structure along a first end and rotatably attached to a lower base frame assembly along a second end for providing vertical height adjustment; said lower base assembly having first support structure horizontal frame attached to a pair of opposing base support structure frames wherein said pair of opposing base support structure frames remain in a fixed position when said pair of vertically extending frames are rotated;

wherein movement of said vertical frame changes the distance between said privacy booth structure and the surface in which the voting booth contacts, and wherein movement of said a privacy booth support structure changes the angular position of said privacy booth structure, and wherein said voting booth is adapted to nest with a like-structured voting booth wherein said voting booth is slidably receivable underneath said like structured voting booth.

2. The multi-purpose adjustable voting booth adapted for nesting in a second like-shaped voting booth according to claim 1.

3. The multi-purpose adjustable voting booth adapted for nesting in a second like-shaped voting booth according to claim 1 wherein said voting booth has a Z-shaped structure.

4. The multi-purpose adjustable voting booth adapted for nesting in a second like-shaped voting booth according to claim 1 wherein said privacy shield fully surrounds the peripheral rear and two opposing side edges of said usable panel.

5. The multi-purpose adjustable voting booth adapted for nesting in a second like-shaped voting booth according to claim 4 wherein said voting booth contains at least two locking members for locking said privacy booth support structure in a desired configuration, and at least two locking members for locking said pair of vertically extending frames in a desired position.

6. The multi-purpose adjustable voting booth adapted for nesting in a second like-shaped voting booth according to claim 1 further including a plurality of locking members, said locking members maintaining said voting booth in a desired configuration.

7. The multi-purpose adjustable voting booth adapted for nesting in a second like-shaped voting booth according to claim 6 wherein said at least two locking members for locking said privacy booth support structure slidably engages a portion of the upper end of at least one of said vertical pair of vertically extending frames when in the locked position and said at least two locking members for locking said pair of vertically extending frames in a desired position slidably engages a portion of the lower end of said at least one of said vertical pair of vertically extending frames when in the locked position.

8. The multi-purpose adjustable voting booth adapted for nesting in a second like-shaped voting booth according to claim 6 wherein said locking members comprising a first pair of locking members for maintaining said privacy booth in a desired configuration, each said first pair locking member comprising a base member secured to each said main body support structure vertical frame and configured to couple to a portion of said privacy booth support structure, and a bracket for securing said privacy booth support structure with said main body support structure vertical frames in a locked position; and a second pair of locking members for maintaining said main body support structure vertical frames in a desired orientation, each said second pair locking member comprising a base member secured to first support structure horizontal frame and configured to couple to each said main body support structure vertical frame, and a bracket for securing said first support structure horizontal frame with said main body support structure vertical frame in a locked position;

said at least one said first pair locking member for locking said privacy booth support structure in a desired configuration maintains said main body support structure vertical frame and said privacy booth support structure in an off center orientation in an unlocked configuration and said opposing said first pair locking members maintains said main body support structure vertical frame and said privacy booth support structure in a centered orientation when in an unlocked position; whereby when said privacy booth support structure is rotated in one direction, at least one locking member is positioned in a locking position and rotation in the opposite direction results in said opposing locking member being placed in the locking position, and said at least one said second pair locking member for locking said pair of vertically extending frames in a desired position maintains said first support structure horizontal frame and said main body support structure vertical frame in an off-center relationship when in an unlocked configuration and said opposing said second pair locking member maintains said first support structure horizontal frame and said main body support structure vertical frame in a centered orientation when in a locked position; whereby when opposing vertical frames are rotated in one direction, at least one said second pair locking member is placed in the locking position and rotation in the opposite direction results in said opposing locking member being placed in the locking position.

9. The multi-purpose adjustable voting booth adapted for nesting in a second like-shaped voting booth according to claim 1 wherein said opposing vertical frames are inclined.

10. The multi-purpose adjustable voting booth adapted for nesting in a second like-shaped voting booth according to claim 1 further including an anti-slip edge.

11. The multi-purpose adjustable voting booth adapted for nesting in a second like-shaped voting booth according to claim 1 wherein said privacy booth further includes a magnifier, a pen, one or more pouches attached to the inner or outer surfaces of said privacy shield, or combinations thereof.

12. The multi-purpose adjustable voting booth adapted for nesting in a second like-shaped voting booth according to claim 1 wherein said privacy booth structure further contains a motion sensor light.

13. The multi-purpose adjustable voting booth adapted for nesting in a second like-shaped voting booth according to claim 12 wherein said light is an LED.

14. The multi-purpose adjustable voting booth adapted for nesting in a second like-shaped voting booth according to claim 13 further including light brightness control.

15. The multi-purpose adjustable voting booth adapted for nesting in a second like-shaped voting booth according to claim 14 further including a control mechanism for controlling the amount of time said light remains on once activated.

16. The multi-purpose adjustable voting booth adapted for nesting in a second like-shaped voting booth according to claim 1 further including one or more castors.

17. The multi-purpose adjustable voting booth adapted for nesting in a second like-shaped voting booth according to claim 1 wherein said lower base assembly further includes a second support structure horizontal frame attached to said pair of opposing vertical frames.

18. A multi-purpose adjustable voting booth adapted for nesting in a second like-shaped voting booth comprising:

a privacy booth structure having a usable panel defined by a front edge, a rear edge, and two opposing side edges, said usable panel being securable to an upper base frame assembly; said privacy booth structure having a privacy shield attached to said usable panel;

a privacy booth support structure for supporting said privacy booth and providing said privacy booth rotatable movement, said privacy booth support structure rotatably attached to a main body support structure for providing angular adjustment to said privacy booth support structure and including a first pair of locking members for maintaining said privacy booth in a desired configuration, each said first pair locking member comprising a base member secured to each said main body support structure vertical frame and configured to couple to a portion of said privacy booth support structure, and a bracket for securing said privacy booth support structure with said main body support structure vertical frames in a locked position; said at least one first pair locking member for locking said privacy booth support structure in a desired configuration maintains said main body support structure vertical frame and said privacy booth support structure in an off center orientation in an unlocked configuration and said opposing first pair locking member maintains said main body support structure vertical frame and said privacy booth support structure in a centered orientation when in an locked position; whereby when said privacy booth support structure is rotated in one direction, at least one locking member is positioned in a locking position and rotation in the opposite direction results in the opposing locking member being placed in the locking position;

said main body support structure having a pair of vertically extending frames, each said vertical frame attached to said privacy booth support structure along a first end and a rotatably attached to a lower base frame assembly along a second end for providing vertical height adjustment; said lower base assembly having first support structure horizontal frame attached to a pair of opposing base support structure frames and including a second pair of locking members for maintaining said main body support structure vertical frames in a desired orientation, each said second pair locking member comprising a base member secured to first support structure horizontal frame and configured to couple to each said main body support structure vertical frame, and a bracket for securing said first support structure horizontal frame with said main body support structure vertical frame in a locked position, said at least one said second pair locking member for locking said pair of vertically extending frames in a desired position maintains said first support structure horizontal frame and said main body support structure vertical frame in an off-center orientation in an unlocked configuration and said opposing second pair locking member maintains said first support structure horizontal frame and said main body support structure vertical frame in a centered orientation when in an unlocked position, whereby when opposing vertical frames are rotated in one direction, at least one said second pair locking member is placed in the locking position and rotation in the opposite direction results in the opposing locking member being placed in the locking position;

wherein movement of said vertical frame changes the distance between said privacy booth structure and the surface in which the voting booth contacts, and wherein movement of said a privacy booth support structure changes the angular position of said privacy booth structure, and wherein said voting booth is adapted to nest with a like-structured voting booth wherein said voting booth is slidably receivable underneath said like structured voting both.

* * * * *